US006981700B2

(12) United States Patent
Syed et al.

(10) Patent No.: US 6,981,700 B2
(45) Date of Patent: Jan. 3, 2006

(54) STRATEGIC BOARD GAME

(76) Inventors: Omar A. Syed, P.O. Box 770762, Lakewood, OH (US) 44107; Aamir G. Syed, P.O. Box 770762, Lakewood, OH (US) 44107

( * ) Notice: Subject to any disclaimer, the term of this patent is extended or adjusted under 35 U.S.C. 154(b) by 38 days.

(21) Appl. No.: 10/679,027

(22) Filed: Oct. 3, 2003

(65) Prior Publication Data

US 2004/0065999 A1 Apr. 8, 2004

Related U.S. Application Data

(60) Provisional application No. 60/415,670, filed on Oct. 3, 2002.

(51) Int. Cl.
*A63F 3/00* (2006.01)

(52) U.S. Cl. ..... 273/260; 273/242

(58) Field of Classification Search ..... 273/260, 273/261, 242, 258; D21/348
See application file for complete search history.

(56) References Cited

U.S. PATENT DOCUMENTS

| | | | | |
|---|---|---|---|---|
| 3,761,092 A | * | 9/1973 | Shieff | 273/239 |
| 3,851,883 A | | 12/1974 | Hitchcock et al. | |
| 4,553,756 A | | 11/1985 | Linnekin | |
| 4,886,279 A | | 12/1989 | Taylor | |
| 5,451,061 A | * | 9/1995 | DeLessio et al. | 273/243 |
| 5,690,332 A | * | 11/1997 | Rechs | 273/260 |
| 5,957,455 A | | 9/1999 | Aldridge | |

FOREIGN PATENT DOCUMENTS

FR 396795 4/1909

OTHER PUBLICATIONS http://www.edcollins.com/stratego/stratego-message-3.htm This supplied history of Stratego and is my source for FR 396,795 summary.
http://www.gamerz.net/pbmserv/stratego.html This is source of my background description of Stratego game.
http://www.arimaa.com website and associated web pages.
http://www.arimaa.com/arimaa/introArticle/.
http://www.arimaa.com/arimaa/learn/rulesIntro.html.
http://www.arimaa.com/arimaa/learn/matchRules.html.
http://www.arimaa.com/arimaa/learn/notation.html.
http://www.arimaa.com/arimaa/learn/.
http://www.arimaa.com/arimaa/about/.

* cited by examiner

*Primary Examiner*—Vishu K. Mendiratta
(74) *Attorney, Agent, or Firm*—Dwight A. Stauffer

(57) ABSTRACT

A turn-based strategic board game played on a gridded board with different strength piece types, wherein a player's higher strength piece is able to move or freeze an opposing player's lower strength piece. A player wins by moving one of his lowest strength pieces to the row farthest away from the winning player. The game board has one or more predetermined trap spaces wherein if a piece is on a trap space, then under certain conditions the piece will be removed from the game. Movement turns proceed in sequence among players. During a player's turn, the player may make optionally multiple moves, optionally divided among a plurality of the player's pieces. Initial setup involves each player placing his pieces in self-determined spaces of the player's first two board rows. In a preferred embodiment, two players can play on an appropriately marked chess board using standard chess pieces.

29 Claims, 4 Drawing Sheets

STRATEGIC BOARD GAME

CROSS-REFERENCE TO RELATED APPLICATIONS

This application claims the benefit of U.S. Provisional Patent Application No. 60/415,670, filed Oct. 3, 2002 by Syed, et al.

TECHNICAL FIELD OF THE INVENTION

The present invention relates to strategic games and, more particularly to strategic games that are played on a gridded board.

BACKGROUND OF THE INVENTION

There are a large number of strategic board games (strategy games played on a game board) on the market today. These each offer their own unique strategy and manner of playing. Many of these have a vast and long history such as chess, checkers, and Go.

One of the most well known strategic board games is chess. Chess is a well established strategy game that has been in existence for centuries. Its nearest predecessor, Chaturanga, is discussed in seventh century Sanskrit writings. Due to the nature of trade, travel and expansion, chess was popular in the known world by the fourteenth century. Chess has been played for centuries by millions of people worldwide. The traditional chess game is one of strategy through predicting an opponent's future movements of the chess pieces in order to plan the attacking and defensive positions accordingly.

There have been variations in the past to both the board and the rules of play for the game of chess, but the most common present day mode of playing chess is established for use on a gridded square game board divided into an eight by eight grid of sixty-four equal spaces, usually distinguished by being colored in an alternating dark and light color pattern, i.e., checkered. The basic rules of play for a conventional chess game include: two players (player and opposing player, or "opponent"), each using sixteen pieces of quantity and type designated as: one king, one queen, two rooks, two bishops, two knights and eight pawns respectively. The object is to capture the opponent's king. Initial setup is a prescribed arrangement of pieces in the two rows closest to the player and at the opposite end of the board from the opposing player. The type of piece is clearly identified for all players and observers, traditionally by the piece's shape. Each piece is movable according to predetermined movement patterns that are different for each type of piece. Play is turn-based, with each player being allowed to move a selected one of their own pieces in a single movement pattern appropriate to the selected piece. The movement patterns include diagonal, horizontal/vertical, and combinations thereof (a 1 by 2 space L-shaped pattern). Some pieces may move multiple spaces while others may only move one space at a time. One of the piece types (pawn) is able to move forward only, while the others are not restricted in movement direction. One of the piece types (knight) is allowed to jump over pieces. All spaces on the board are available for movement, but no two pieces may occupy the same space. Any opposing player's piece is captured (removed from the board) when any one of a player's pieces moves into the space where the opposing player's piece resides. The capturing piece must be moved according to its predetermined movement pattern (except for the pawn) such that the movement pattern ends in the captured piece's space. Other than removing an opponent's captured piece, a player may only move his own piece(s) during his turn. There are four exception moves: pawn capturing, en passant, castling and queening. In the pawn capturing move, the pawn (which normally moves vertically forward only) moves diagonally forward to capture any opponent's piece in the diagonally forward space. In the en passant move, the pawn captures an opponent's pawn (only) by moving diagonally forward behind a horizontally adjacent opponent's pawn to capture the opponent's pawn even though the player's pawn does not end up in the same space as the captured and removed opponent's pawn. In castling, the player's king (which normally moves only 1 space) is moved two spaces horizontally towards a selected one of the player's rooks, and then the selected rook (which normally does not jump pieces) is jumped over the king to end up horizontally adjacent to the king on the other side of the king. The castling move is only permitted when: there are no pieces intervening between the king and the selected rook; neither the king nor the selected rook can have been moved prior to the castling move; and the king must not be under threat of capture ("in check") in any of the three spaces it will occupy during the castling move. In the queening move, a player's pawn is turned into a queen if it is moved into the farthest row away from the player.

There are many variants on the traditional game of chess. For example, U.S. Pat. No. 5,957,455 (Aldridge; 1999), discloses a concealed chess game wherein the type of a player's pieces is always evident to the player, but not to the opposing player. This introduces the element of memory and deduction as a player must deduce the type of an opponent's piece from the movement pattern used by said piece. Optional rules allow initial setup in random or player-determined positioning of the player's pieces, potentially anywhere on the game board. Movement patterns and other game rules generally correspond to standard chess rules, although some variations are proposed, including more than two players, and the use of one or more "barrier pieces" that prevent movement in or through the space occupied by the barrier piece.

U.S. Pat. No. 4,553,756 (Linnekin; 1985), discloses a circular chess game played on a substantially planar game surface and includes fourteen generally straight, elongated radial zones spaced about and extending outward from a central zone. Each of the radial zones includes eight discrete spaces of two alternating colors spaced therealong and each set of corresponding spaces of the zones are disposed in an annular path extending about the central zone and the colors of each set of annular path spaces alternate thereabout. U.S. Pat. No. 3,851,883 (Hitchcock, et al.; 1974), discloses a chess game board of multiple spiral configuration provided with a center space or island and intended for a predetermined number of players depending upon the structure of the board; the number of players determining the number of spirals required for the game board. U.S. Pat. No. 4,886,279 (Taylor; 1989), discloses a circular game board for the game of chess and other games such as checkers, consisting of four concentric rings of playing areas, the center ring being circular. The center ring has four playing areas, the second ring twelve, the third ring twenty and the fourth ring twenty-eight. Four rows of corner playing areas, which may all be trilateral, radiate symmetrically from the center of the board. The outermost corner areas may be other shapes, such as circular or rhombic. The remainder of the playing areas are quadrilateral. The board is suitable for playing a conventional game of chess, but also adapts itself to a slightly modified game where the rook and queen pieces are allowed to travel around the board, moving from rank to file to create a logically valid flanking action. In the Linnekin, Hitchcock and Taylor patents, the movement patterns of the game pieces are generally similar to those of a standard chess game, but adapted to circular or spiral game boards.

There are also currently many computer programs that offer someone competition to many strategic board games. These are currently called Computer Bots. IBM's "Deep Blue" was designed to play and defeat the world's best chess players. The game of chess has few enough options for moves that it is relatively easy for computer bots to process all of the options to determine the best move to make against the human player. When playing strategic board games such as chess, humans use their problem solving capability, experience and intuition to pick what they judge to be the best move for the current situation. The computer, however, generally tries all possible move combinations on an internal board to look ahead as far as possible so that it can pick the move which leads to the most favorable positions. This brute force approach of looking at all the moves in the game is quite different from the way humans play chess or any other strategic board game. The advances in computer hardware have allowed computers to look at more and more of the moves and future moves so that specially designed hardware can now defeat the best human chess player. Some of the bots have an accumulation of chess knowledge in the form of databases for openings and end games, significantly improving the performance of chess programs. Thus there appears to be a need for strategy games that are harder for the computer to win.

A strategic board game called Stratego® increases the complexity of chess-like games by modifying the board and the types of pieces, concealing the types of pieces, redefining movement patterns for the pieces (especially as relates to capturing), and using a player-determined initial setup. Stratego®, is trademarked (registration number 0695583 in 1960) and copyrighted (1961) in the U.S., and is based on a French game called L'Attaque, disclosed as "a battle game with mobile pieces on a gameboard" in a French Patent No. 396.795 (Edan; 1909). The game of Stratego® has pieces with different strengths, with each player taking one move per turn. As the playing pieces of two opponents collide, the values of the pieces are compared and the weaker piece is removed from the game. The strength of a player's piece is hidden from the opponent and only revealed upon collision. Initial setup of the board involves each player placing her pieces in any desired location within the four rows closest to the player. The currently popular way of playing Stratego® conforms to the following summary of rules, adapted from a description published, for example, on the internet website http://www.gamerz.net/pbmserv/stratego.html.

The object of Stratego® is to capture the opponent's Flag. The game is played on a 10×10 (10 space by 10 space grid) game board (although optional rules are available for playing a scaled down "small" version of Stratego® on an 8×8 board). The game board is modified to have two "lakes" in the middle, a lake being an area that playing pieces may not be moved into or over. Each lake is a 2×2 area comprising the third and fourth spaces in from each side of the board, and in the fifth and sixth rows. Each of the two players has an army of 40 pieces comprising 12 different types, but all 40 pieces appear identical to the opposing player; i.e., a player's piece types are concealed from the opposing player, but always visible for the player. The type of an opponent's piece is only revealed to a player when the player's piece collides with the opponent's piece.

In an initial setup before starting the game, each player deploys his army by filling the four rows closest to the player with his 40 pieces. The opponent does not see the player's piece types; only where the pieces are located. Twelve different types of pieces are used in Stratego®, as listed in the following table with rank, and quantity deployed.

| STRATEGO ® PIECE TYPE | RANK | QUANTITY |
|---|---|---|
| Bomb | B | 6 |
| Marshall | 1 | 1 |
| General | 2 | 1 |
| Colonel | 3 | 2 |
| Major | 4 | 3 |
| Captain | 5 | 4 |
| Lieutenant | 6 | 4 |
| Sergeant | 7 | 4 |
| Miner | 8 | 5 |
| Scout | 9 | 8 |
| Spy | 10 | 1 |
| Flag | F | 1 |

Stratego® piece movement: In a player's turn, a selected one of the player's movable pieces can be moved through unoccupied non-lake spaces according to the selected piece's designated movement pattern. Bombs and Flags cannot be moved from their initial placement, while all other (movable) pieces, except the Scout, move a single space horizontally or vertically. The Scout also moves horizontally or vertically, but may move any number of spaces, unless blocked by other pieces or a lake. When a player's piece attacks by moving onto the same space as one of the opponent's pieces, a conflict (capture move) occurs. The types of the two conflicting pieces are revealed and the piece with the higher strength (lower rank number, subject to exceptions) wins. The losing piece is captured, i.e., removed from the board and its vacated spot is then occupied by the winning piece. If the pieces are equal in rank, then both are removed from the board. Any piece may capture the Flag, thereby winning the game. Two exceptions to the capturing rules are: (a) The Bomb has a higher strength than any other piece except the Miner. The Miner can "defuse" (capture) Bombs, but otherwise can capture only the lower strength Scout, Spy, and Flag. (b) The Spy may capture the Marshall, but only if the Spy is attacking. If the Marshall attacks the Spy, the Spy is captured. Against all other pieces, except the Flag, the Spy always loses.

Many of the classical strategic board games such as checkers, chess, and Go were developed centuries ago before computers were even conceived. Thus they were not designed to be difficult for computers to play. With the exception of Go, computers have become extremely strong players at these games and are currently on par with the best human players.

It is an object of the present invention to improve upon existing strategy games by creating a strategic board game that will be much harder for a computer to play, yet enjoyable, highly competitive, and readily playable by human opponents. It is a further object to design the inventive game in a way that it can be played by adapting a standard chess board and chess pieces.

BRIEF SUMMARY OF THE INVENTION

According to the invention: a method for playing a strategic board game wherein the game is played by two or more players on a game board that is gridded to designate spaces such that a quantity of pieces that are identifiable as belonging to each of the two or more players are positioned within, and moved among, the spaces; the method comprising the steps of:

requiring that the two or more players take turns for being an active player that is allowed to move one or more of the active player's pieces;

allowing the active player to move or position the active player's pieces in a way that manipulates by pushing or pulling an opposing player's pieces, wherein the opposing player's pieces are pieces that belong to an opposing player that is one of the two or more players other than the active player; and wherein:

pushing is a push move that comprises using a one of the active player's pieces to push a one of the opposing player's pieces out of a first space and into a second unoccupied space, and then moving the one of the active player's pieces into the first space; and pulling is a pull move that comprises moving a one of the active player's pieces out of a third space and into a fourth unoccupied space, and then using the one of the active player's pieces to pull a one of the opposing player's pieces into the third space.

The step of manipulating the opposing player's pieces further comprises the step of:

using a one of the active player's pieces to freeze a one of the opposing player's pieces, thereby preventing movement of the one of the opposing player's pieces by the opposing player.

Further comprising the step of: providing means for any one of the two or more players to protect a piece that belongs to the one of the two or more players; such that protecting a one piece unfreezes or otherwise prevents freezing of the one piece.

4. The method of claim 1, wherein the game board further comprises one or more spaces that are designated as trap spaces; and the method further comprises the step of:

removing from the game a piece that is moved into a one of the one or more trap spaces.

5. The method of claim 4, further comprising the step of:

providing means for any one of the two or more players to protect a piece that belongs to the one of the two or more players; such that protecting a one piece prevents removal of the one piece when the one piece is in a one of the one or more trap spaces.

6. The method of claim 1, further comprising the step of:

limiting the step of manipulating the opposing player's pieces such that a one of the active player's pieces manipulates only a one of the opposing player's pieces that is in a space that is adjacent to the one of the active player's pieces.

7. The method of claim 1, further comprising the step of:

assigning a type to each one of the quantity of pieces belonging to each of the two or more players, wherein there are at least two varieties of type;

predetermining a strength value for each one of the at least two varieties of type, wherein the strength value is selected from a hierarchy of strength values from weak to strong, such that when a first piece having a first type with a first strength value is compared to a second piece having a second type with a second strength value, if the first strength value is stronger than the second strength value, then the first piece is a stronger piece relative to the second piece which is a weaker piece relative to the first piece; and allowing only stronger pieces to manipulate weaker pieces.

8. The method of claim 7, wherein the game board comprises a rectangular array of orthogonally adjacent spaces arranged in rows and columns; and the method further comprises the steps of:

assigning a first row, a second row, and a goal row for each one of the two or more players;

during the first turn of the game each active player determines an initial setup for the active player's pieces wherein the active player's pieces are arranged in the spaces within the active player's first row and second row; and completing an instance of playing the strategic board game wherein one of the two or more players wins by being the first one of the two or more players to move a one of the winning player's weakest pieces to the goal row assigned to the winning player.

9. The method of claim 1, further comprising the steps of:

during one turn, allowing the active player to move or cause to move one or more of the pieces a total of one to four turn steps, wherein a turn step comprises a piece being moved from one space to any adjacent unoccupied space;

determining that a push move or a pull move uses two of the turn steps in a turn; and requiring that a push move or a pull move must be completed within one turn.

10. The method of claim 9, wherein the game board comprises a rectangular array of orthogonally adjacent spaces arranged in rows and columns; and the method further comprises the step of:

defining adjacent spaces as spaces that are orthogonally adjacent, row-wise or column-wise.

11. The method of claim 1, further comprising the step of:

requiring that a first push move or pull move must be completed before a second push move or pull move can be performed.

12. A method for playing a strategic board game wherein the game is played by two or more players on a game board that is gridded to designate spaces such that a quantity of pieces that are identifiable as belonging to each of the two or more players are positioned within, and moved among, the spaces; the method comprising the steps of:

requiring that the two or more players take turns for being an active player that is allowed to move one or more of the active player's pieces; and allowing the active player to move or position the active player's pieces in a way that manipulates by using a one of the active player's pieces to freeze a one of the opposing player's pieces, thereby preventing movement of the one of the opposing player's pieces by the opposing player.

13. The method of claim 12, further comprising the step of:

providing means for any one of the two or more players to protect a piece that belongs to the one of the two or more players; such that protecting a one piece unfreezes or otherwise prevents freezing of the one piece.

14. The method of claim 12, wherein the step of manipulating the opposing player's pieces further comprises the steps of:

pushing or pulling an opposing player's pieces, wherein the opposing player's pieces are pieces that belong to an opposing player that is one of the two or more players other than the active player; and wherein:

pushing is a push move that comprises using a one of the active player's pieces to push a one of the opposing player's pieces out of a first space and into a second unoccupied space, and then moving the one of the active player's pieces into the first space; and pulling is a pull move that comprises moving a one of the active player's pieces out of a third space and into a fourth unoccupied space, and then using the one of the active player's pieces to pull a one of the opposing player's pieces into the third space.

15. The method of claim 12, wherein the game board further comprises one or more spaces that are designated as trap spaces; and the method further comprises the step of:

removing from the game a piece that is moved into a one of the one or more trap spaces.

16. The method of claim 15, further comprising the step of:

providing means for any one of the two or more players to protect a piece that belongs to the one of the two or more players; such that protecting a one piece prevents removal of the one piece when the one piece is in a one of the one or more trap spaces.

17. The method of claim 12, further comprising the step of:

limiting the step of manipulating the opposing player's pieces such that a one of the active player's pieces manipulates only a one of the opposing player's pieces that is in a space that is adjacent to the one of the active player's pieces.

18. The method of claim 12, further comprising the step of:

assigning a type to each one of the quantity of pieces belonging to each of the two or more players, wherein there are at least two varieties of type;

predetermining a strength value for each one of the at least two varieties of type, wherein the strength value is selected from a hierarchy of strength values from weak to strong, such that when a first piece having a first type with a first strength value is compared to a second piece having a second type with a second strength value, if the first strength value is stronger than the second strength value, then the first piece is a stronger piece relative to the second piece which is a weaker piece relative to the first piece; and allowing only stronger pieces to manipulate weaker pieces.

19. The method of claim 18, wherein the game board comprises a rectangular array of orthogonally adjacent spaces arranged in rows and columns; and the method further comprises the steps of:

assigning a first row, a second row, and a goal row for each one of the two or more players;

during the first turn of the game each active player determines an initial setup for the active player's pieces wherein the active player's pieces are arranged in the spaces within the active player's first row and second row; and completing an instance of playing the strategic board game wherein one of the two or more players wins by being the first one of the two or more players to move a one of the winning player's weakest pieces to the goal row assigned to the winning player.

20. The method of claim 12, further comprising the step of:

during one turn, allowing the active player to move or cause to move one or more of the pieces a total of one to four turn steps, wherein a turn step comprises a piece being moved from one space to any adjacent unoccupied space.

21. The method of claim 20, wherein the game board comprises a rectangular array of orthogonally adjacent spaces arranged in rows and columns; and the method further comprises the step of:

defining adjacent spaces as spaces that are orthogonally adjacent, row-wise or column-wise.

22. A method for playing a strategic board game wherein the game is played by two or more players on a game board that is gridded to designate spaces such that a quantity of pieces that are identifiable as belonging to each of the two or more players are positioned within, and moved among, the spaces; the method comprising the steps of:

designating one or more spaces as trap spaces; and removing from the game a piece that is moved into a one of the one or more trap spaces.

23. The method of claim 22, further comprising the step of:

providing means for any one of the two or more players to protect a piece that belongs to the one of the two or more players; such that protecting a one piece prevents removal of the one piece when the one piece is in a one of the one or more trap spaces.

24. A method for playing a strategic board game wherein the game is played by two or more players on a game board that is gridded to form a rectangular array of orthogonally adjacent spaces arranged in rows and columns such that a quantity of pieces that are identifiable as belonging to each of the two or more players are positioned within, and moved among, the spaces; the method comprising the steps of:

assigning a type to each one of the quantity of pieces belonging to each of the two or more players, wherein there are at least two varieties of type;

predetermining a strength value for each one of the at least two varieties of type, wherein the strength value is selected from a hierarchy of strength values from weak to strong, such that when a first piece having a first type with a first strength value is compared to a second piece having a second type with a second strength value, if the first strength value is stronger than the second strength value, then the first piece is a stronger piece relative to the second piece which is a weaker piece relative to the first piece;

assigning a first row, a second row, and a goal row for each one of the two or more players;

requiring that the two or more players take turns for being an active player that is allowed to move one or more of the active player's pieces;

during the first turn of the game each active player determines an initial setup for the active player's pieces wherein the active player's pieces are arranged in the spaces within the active player's first row and second row; and completing an instance of playing the strategic board game wherein one of the two or more players wins by being the first one of the two or more players to move a one of the winning player's weakest pieces to the goal row assigned to the winning player.

25. A strategic board game apparatus for playing a strategic board game by two or more players, the apparatus comprising a game board that is gridded to designate an array of spaces;

a quantity of pieces that are identifiable as belonging to each of the two or more players, wherein the pieces can be positioned within, and moved among, the spaces; and one or more spaces that are identifiable as trap spaces for removing from the game a piece that is moved into a one of the one or more trap spaces.

26. The apparatus of claim 25, wherein:

the game board comprises a rectangular array of orthogonally adjacent spaces arranged in rows and columns.

27. The apparatus of claim 26, wherein:

a type is assigned to each one of the quantity of pieces belonging to each of the two or more players, wherein there are at least two varieties of type;

a strength value is predetermined for each one of the at least two varieties of type, wherein the strength value is selected from a hierarchy of strength values from weak to strong, such that when a first piece having a first type with a first strength value is compared to a second piece having a second type with a second strength value, if the first strength value is stronger than the second strength value, then the first piece is a stronger piece relative to the second piece which is a weaker piece relative to the first piece;

assigning a first row, a second row, and a goal row for each one of the two or more players;

such that an initial setup of pieces comprises positioning pieces within the first row and the second row, and an instance of the game is won by moving a designated type of piece to the goal row.

Other objects, features and advantages of the invention will become apparent in light of the following description thereof.

BRIEF DESCRIPTION OF THE DRAWINGS

Reference will be made in detail to preferred embodiments of the invention, examples of which are illustrated in the accompanying drawing figures. The figures are intended to be illustrative, not limiting. Although the invention is generally described in the context of these preferred embodiments, it should be understood that it is not intended to limit the spirit and scope of the invention to these particular embodiments.

Certain elements in selected ones of the drawings may be illustrated not-to-scale, for illustrative clarity. Elements of the figures can be numbered such that similar (including identical) elements may be referred to with similar numbers in a single drawing. For example, each of a plurality of elements collectively referred to as 199 may be referred to individually as 199*a*, 199*b*, 199*c*, etc. For example, each of a plurality of elements collectively referred to as 199*a* may be referred to individually as 199$a_1$, 199$a_2$, 199$a_3$, etc. Or, related but modified elements may have the same number but are distinguished by primes. For example, 109, 109', and 109" are three different elements which are similar or related in some way, but have significant modifications, e.g., a tire 109 having a static imbalance versus a different tire 109' of the same design, but having a couple imbalance. Such relationships, if any, between similar elements in the same or different figures will become apparent throughout the specification, including, if applicable, in the claims and abstract.

Figure 1:
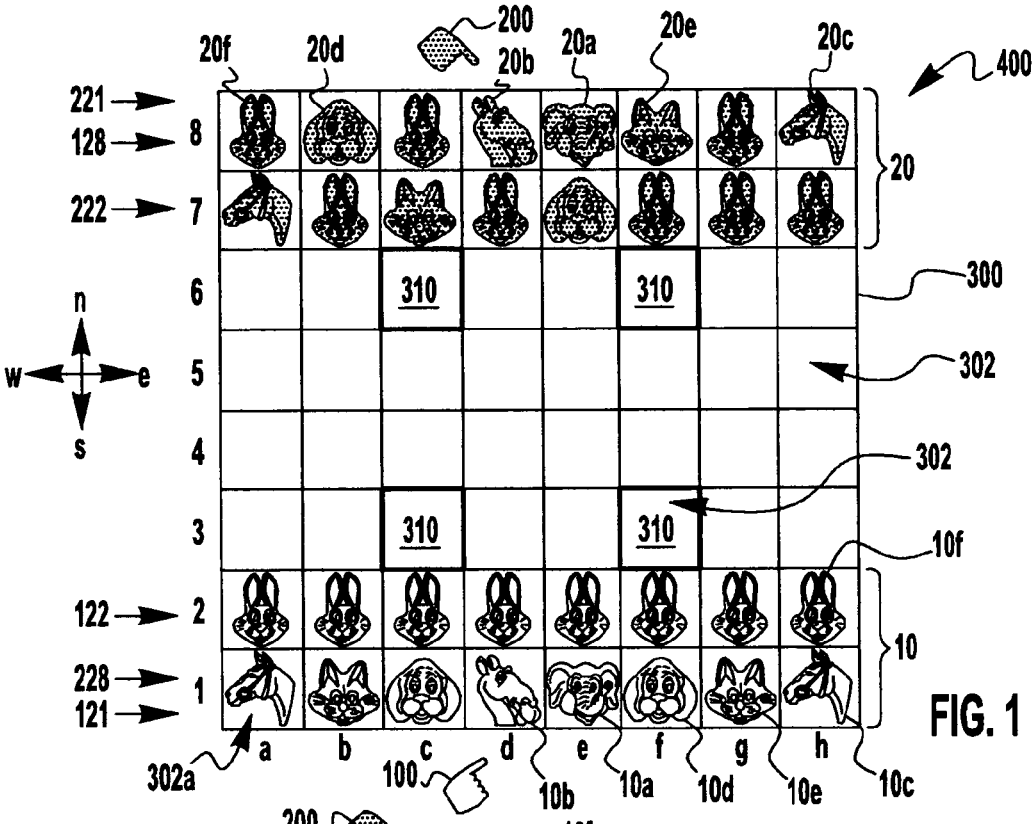
Figure 2:
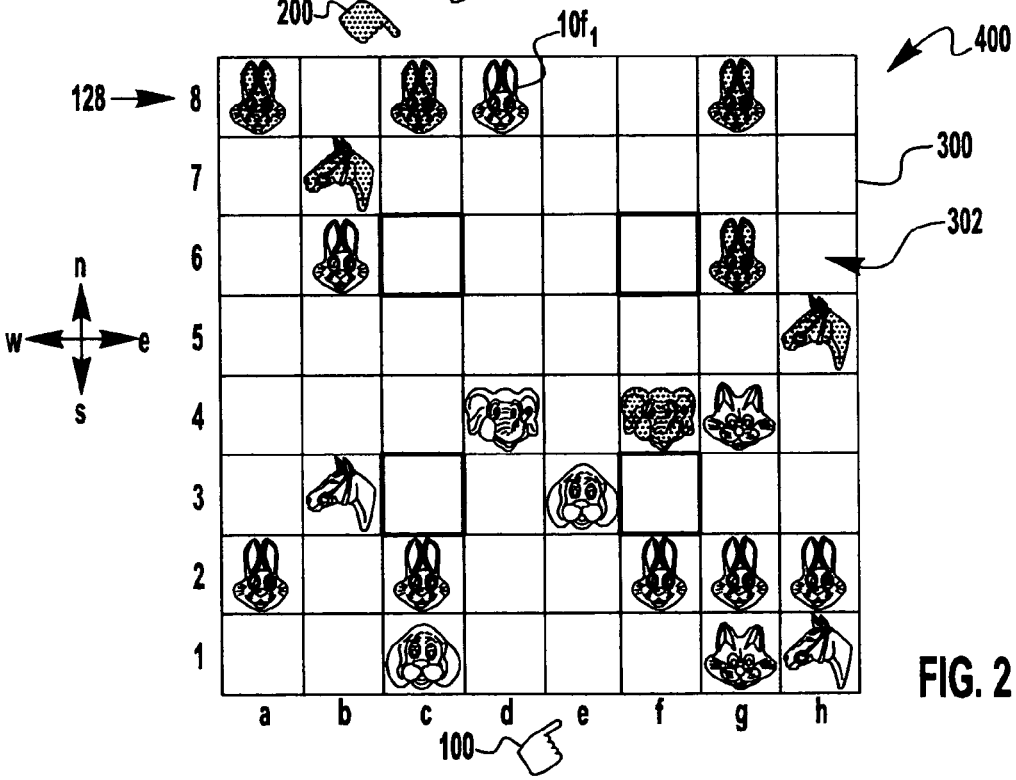
Figure 3:
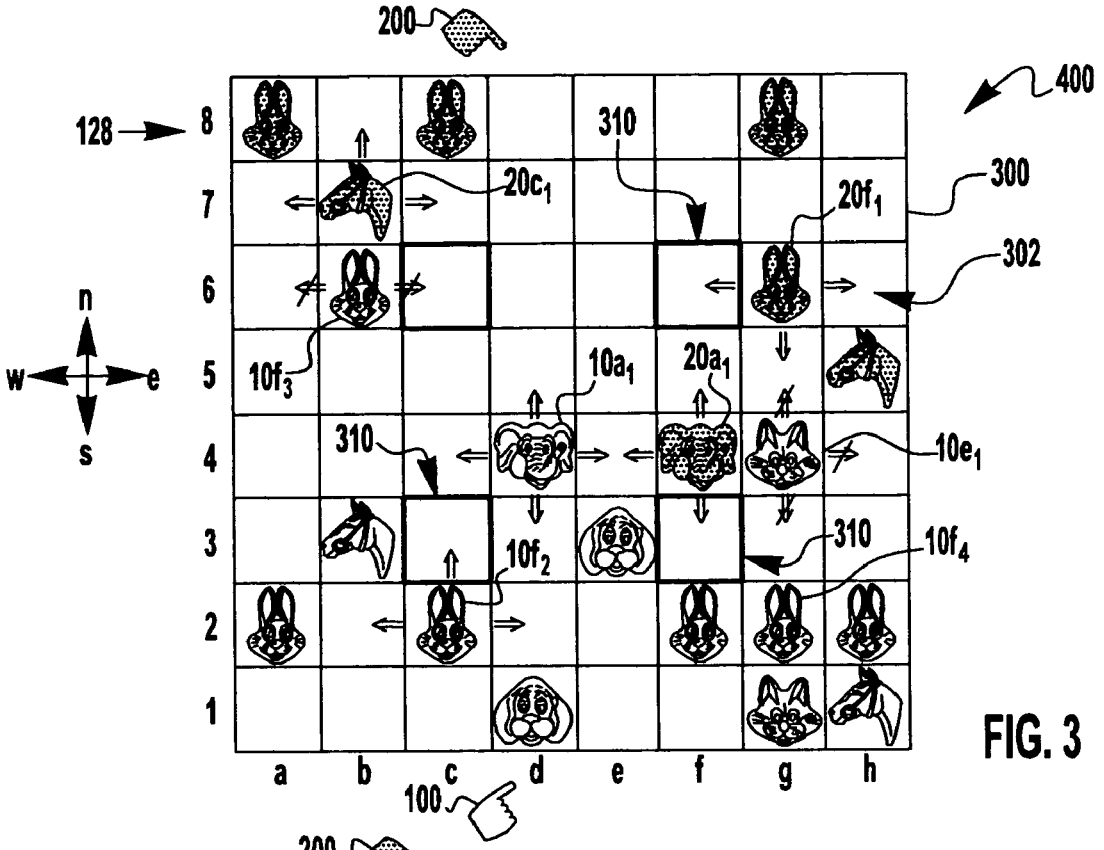
Figure 4:
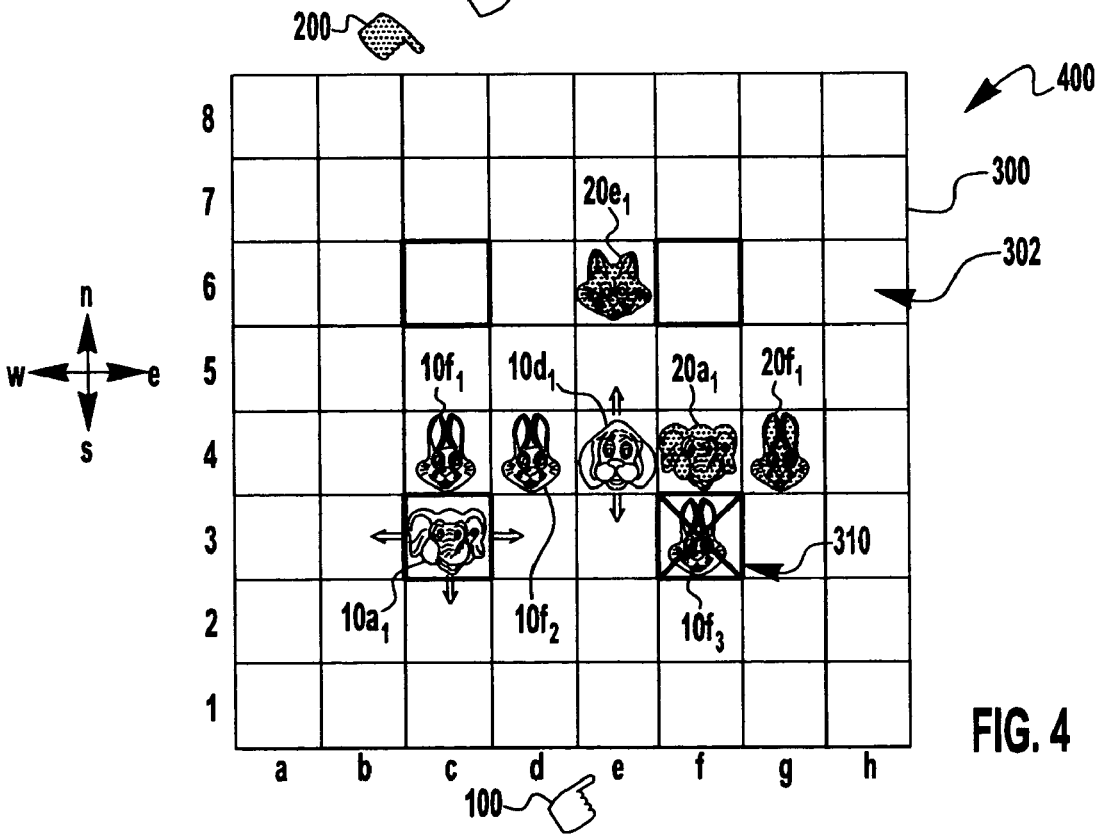
Figure 5:
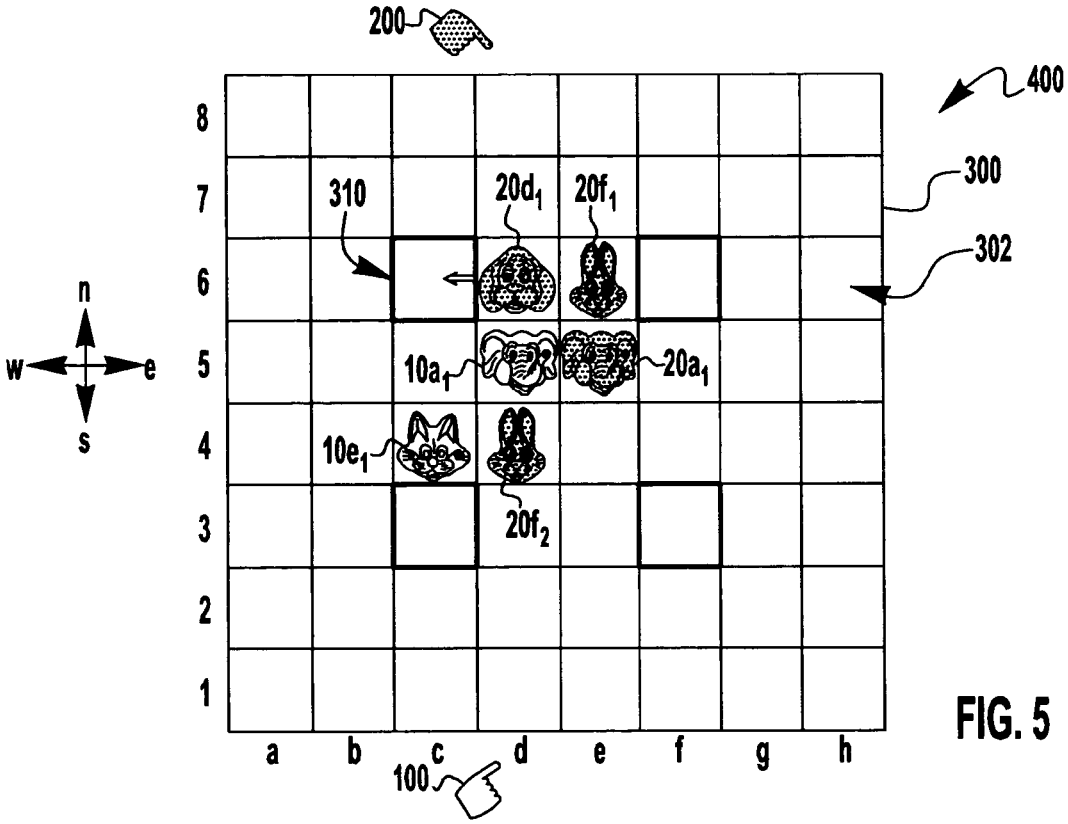
Figure 6:
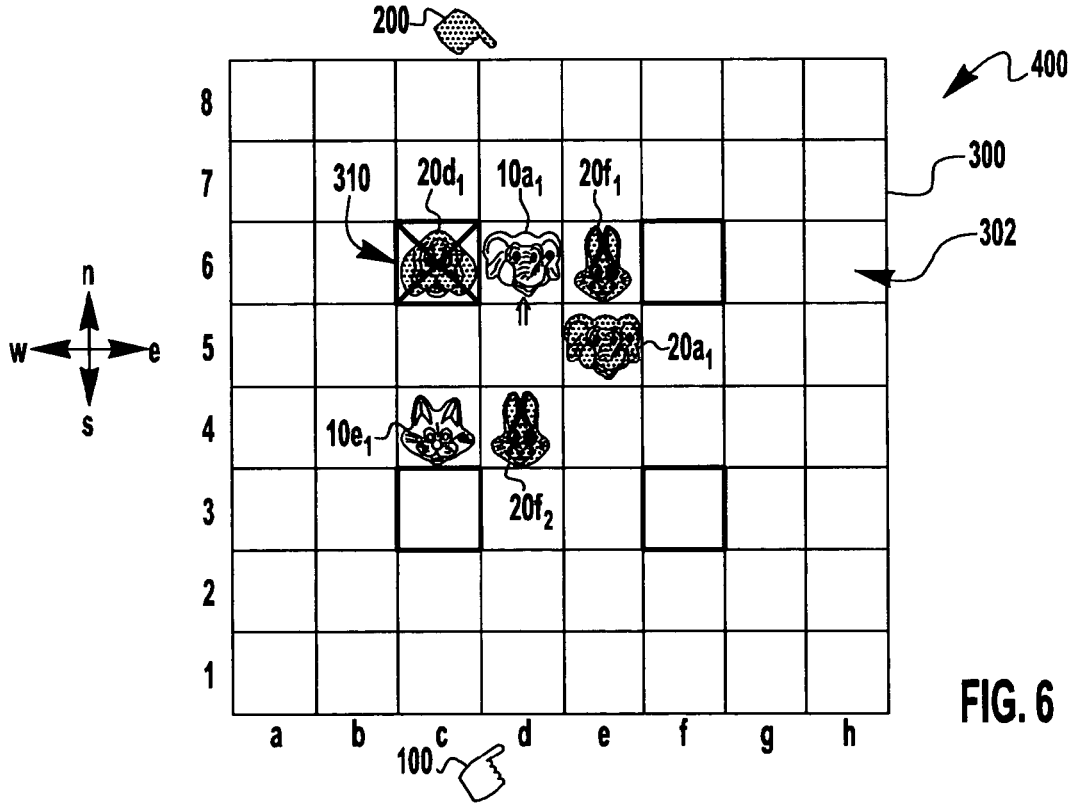
Figure 7:
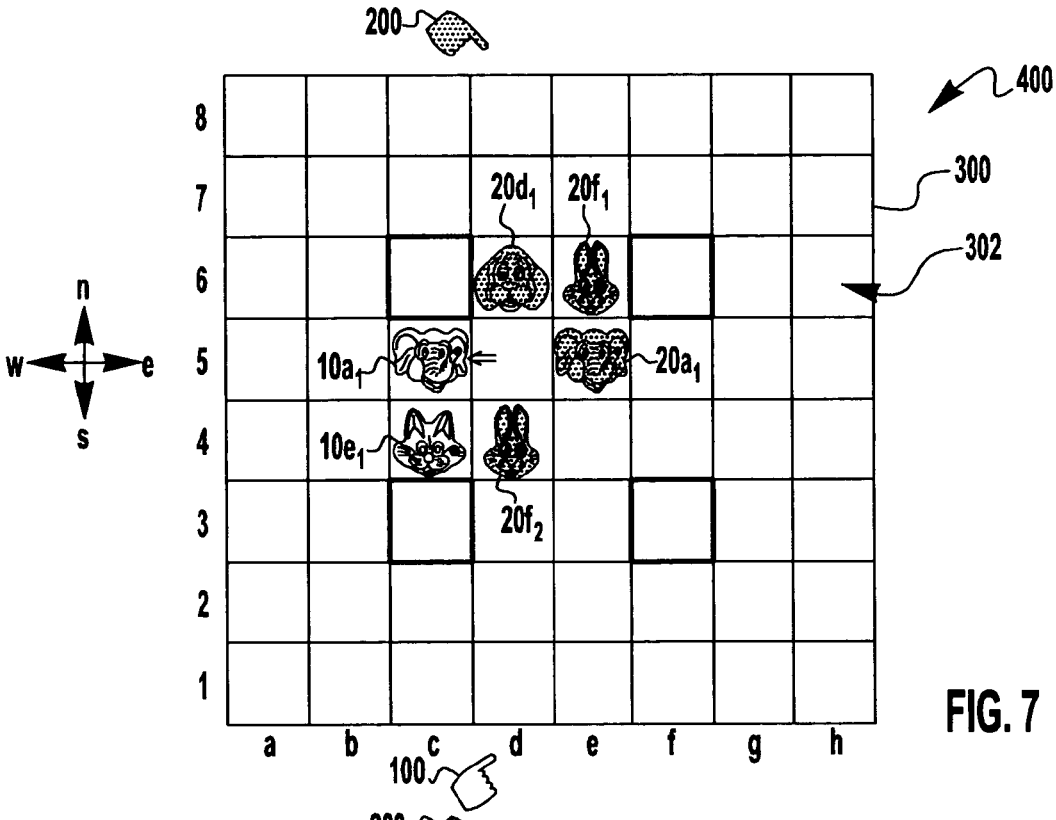
Figure 8:
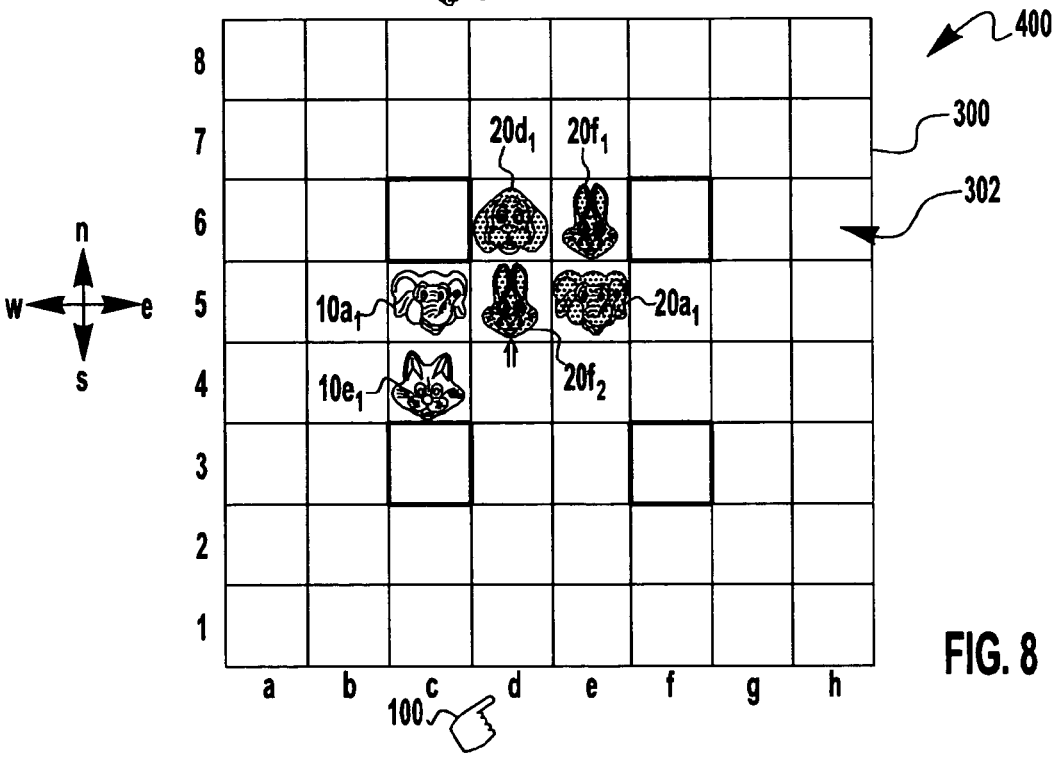

The structure, operation, and advantages of the present preferred embodiment of the invention will become further apparent upon consideration of the following description taken in conjunction with the accompanying drawings, wherein:

FIG. 1 is a schematic top view of a game board and pieces for two players wherein the pieces are arranged in an initial setup, according to the invention;

FIG. 2 is a schematic top view of the game board and pieces for two players illustrating a winning board position, according to the invention;

FIG. 3 is a schematic top view of the game board and pieces for two players illustrating piece movement patterns and freezing of pieces, according to the invention;

FIG. 4 is a schematic top view of the game board and pieces for two players illustrating freezing, trap removal, and protection from freezing and trap removal of pieces, according to the invention;

FIG. 5 is a schematic top view of the game board and pieces for two players illustrating a first step of a push move, according to the invention;

FIG. 6 is a schematic top view of the game board and pieces for two players illustrating a second step of the push move of FIG. 5 plus an example of trap removal of a piece, according to the invention;

FIG. 7 is a schematic top view of the game board and pieces for two players illustrating a first step of a pull move, according to the invention; and FIG. 8 is a schematic top view of the game board and pieces for two players illustrating a second step of the pull move of FIG. 7, according to the invention.

DETAILED DESCRIPTION OF THE INVENTION

The present invention is a strategic board game apparatus and method of play that increases the complexity of chess-like games such that it should be much harder for a computer to play, yet enjoyable, highly competitive, and readily playable by human opponents. Game enhancement techniques include some new techniques (e.g., allowing one player's piece to manipulate another player's piece) and many of the same techniques employed by the prior art game of Stratego®, described in the background hereinabove, i.e., modifying the board and the types of pieces, redefining movement patterns for the pieces (especially as relates to capturing), and using a player-determined initial setup; but the detailed implementation of the inventive enhancements are believed to produce a greatly improved game compared to prior art games including chess and Stratego®.

The preferred embodiment of the present invention is a game named "Arimaa" by the inventor, and is described in a website presently having a URL of 'http://www.arimaa-.com'. The preferred game embodiment was designed as a two player board game that can be played using a standard chess set with a suitably marked chess game board. Therefore the preferred embodiment of game apparatus utilizes a square gridded game board having a total of 64 square spaces in an 8×8 (eight by eight) pattern, and sixteen pieces for each player comprising six different piece types that are at least visually distinguishable for both players: one of a first type (e.g., chess King), one of a second type (e.g., chess Queen), two of a third type (e.g., chess Rook), two of a fourth type (e.g., chess Bishop), two of a fifth type (e.g., chess Knight), and eight of a sixth type (e.g., chess Pawn). The chess board is adapted by being marked (e.g., by placing a coin in the space) in a way that indicates the location of preferably four trap spaces, as detailed hereinbelow. For the sake of clarity in the foregoing description, illustrations and descriptive terms will be used that are unique to the present invention, but it should be apparent how the inventive piece types and board design can be translated for use with standard chess apparatus. Preferably, the inventive game will have its own unique and distinctive appearing board and pieces. Furthermore, it should be apparent that obvious variations and extensions of the herein described inventive method of game playing (i.e., the game) can be adapted to other apparatus while still being within the scope of the present invention.

The Board

FIG. 1 shows a preferred embodiment of an inventive game board 300 for the inventive game 400. The board 300 comprises a square board with a total of sixty-four spaces 302 arranged in an eight-row by eight-column pattern.

Preferably the spaces 302 are not checkered. For notation purposes (e.g., for recording game moves), the rows are referred to by sequential row numbers from 1 through 8, with a row 1 preferably shown in illustrations as being across the bottom of the board 300; and the columns are referred to by column letters in alphabetic order using lower case letters from "a" through "h", with a column "a" preferably shown along the left side of the board 300 when illustrated. Thus the bottom left corner space 302*a* of the board 300 can be referred to as "space a1". Further for notation purposes, the four compass directions north (n), south (s), east (e), and west (w) are used to refer to movement directions as indicated by the arrows in FIG. 1, wherein the north and south directions are aligned with columns, and the east and west directions are aligned with rows (e.g., the north direction "n" is up, or column-wise movement to higher numbered rows). In the preferred embodiment, four of the spaces 302 are clearly marked on the board 300 as trap spaces 310. The trap spaces 310 comprise spaces 302 located at the intersections of the third and sixth rows with the third and sixth columns, i.e., spaces c3, c6, f3, and f6. As will be described hereinbelow, the trap spaces 310 provide means for permanently removing pieces from the game.

A first player 100, usually designated as a white player 100 (White 100), is shown as playing from the bottom of the board 300, such that row 1 is a white first row 121, row 2 is a white second row 122, and the farthest away row 8 is a white goal row 128. A second player 200, usually designated as a black player 200 (Black 200), is shown as playing from the top of the board 300, such that row 8 is a black first row 221, row 7 is a black second row 222, and the farthest away row 1 is a black goal row 228.

The Pieces

Still referring to FIG. 1, the white player 100 has sixteen first pieces 10, usually designated as white pieces 10. Similarly, the black player 200 has sixteen second pieces 20, usually designated as black pieces 20.

There are six different piece types for the first and second pieces 10, 20 (white pieces 10, black pieces 20, collectively referred to as pieces 10, 20), wherein each has a different strength in a hierarchy of strengths from weakest to strongest. Preferably the different piece types are given different animal names and each physical playing piece 10, 20 is in the shape of, or bears an image of, its respective animal wherein the animals should be universally recognized as having relative strengths suitable for the respective piece types. Each of the first and second players 100, 200 (collectively referred to as players 100, 200) has the same set of six piece types, the first player's pieces 10 being distinguished from the second player's pieces 20 by, for example, a color (white or black). The different piece types are shown with their strengths and quantities in the following table along with a preferred representative animal as well as a suggested chess piece that can be used in its place. The strength of the piece type is indicated by a number from 1 (weakest) to 6 (strongest). Each of the players 100/200 (White/Black) has one first piece type 10*a*/20*a* (white Elephant/black Elephant) which is the strongest type with a strength of 6; one second piece type 10*b*/20*b* (white Camel/black Camel) which is the next strongest piece with a strength of 5; two third piece types 10*c*/20*c* (white Horses/black Horses) which are the next strongest pieces with a strength of 4; two fourth piece types 10*d*/20*d* (white Dogs/black Dogs) which are the next strongest pieces with a strength of 3; two fifth piece types 10*e*/20*e* (white Cats/black Cats) which are the next strongest pieces with a strength of 2; and eight sixth piece types 10*f*/20*f* (white Rabbits/black Rabbits) which are the weakest pieces with a strength of 1.

| ARIMAA PIECE TYPE | STRENGTH | QUANTITY | CHESS PIECE |
|---|---|---|---|
| (first) Elephant | 6 | one | King |
| (second) Camel | 5 | one | Queen |
| (third) Horse | 4 | two | Rook |
| (fourth) Dog | 3 | two | Bishop |
| (fifth) Cat | 2 | two | Knight |
| (sixth) Rabbit | 1 | eight | Pawn |

Thus the preferred embodiment of the game playing apparatus for the game 400 comprises the board 300, gridded in an eight row by eight column (8×8) array of sixty-four spaces 302, and having four suitably marked trap spaces 310; plus sixteen first pieces 10 of six different types 10*a*, 10*b*, 10*c*, 10*d*, 10*e*, 10*f* (in the quantities indicated above) for a first player 100; plus sixteen second pieces 20 of six different types 20*a*, 20*b*, 20*c*, 20*d*, 20*e*, 20*f* (in the quantities indicated above) for a second player 200.

Overall Game Play

As in chess, the inventive game 400 is turn-based with players 100, 200 alternating turns, and the first player 100 (White 100, or the player with the lighter colored physical pieces 10) always goes first. The game 400 starts with White 100 arranging the white pieces 10 in a first instance of an initial setup, followed by Black 200 arranging the black pieces 20 in a second instance of the initial setup. The initial setup is considered to be the first turn of a game session, i.e., an instance of playing the game 400. Referring to FIG. 1, there is no fixed arrangement of pieces 10, 20 in the initial setup, other than a requirement that the white pieces 10 are arranged within the two rows closest to White 100 (i.e., the white first row 121 and the white second row 122), and then the black pieces 20 are arranged within the two rows closest to Black 200 (i.e., the black first row 221 and the black second row 222). The goal of the game 400 is to be the first one of the players 100, 200 to move one of the weakest pieces (the Rabbit 10*f*/20*f*) belonging to the first one of the players 100, 200 across the board 300 to the goal row 128, 228 of the first one of the players 100, 200 (i.e., the row on the opposite side of the board 300 from where the winning Rabbit 10*f*/20*f* started after initial setup). For example, FIG. 2 shows a game-winning situation wherein White 100 has managed to move one of her White Rabbits 10$f_1$ into the white goal row 128, thereby ending the game session with White (first player 100) winning the game session.

After initial setup, the first and second players 100, 200 alternate turns of play, with White 100 always taking the first turn after initial setup. During their turn, one of the players 100, 200 (e.g., first player 100) becomes an "acting player" and can move the acting player's pieces (e.g., first pieces 10) according to rules of movement, fully described hereinbelow, that include inventive means for the acting player (e.g., white player 100) to manipulate an opposing player's pieces (e.g., white pieces 20). For example, the rules of movement include: means for removing pieces 10, 20 from the game via the trap spaces 310; means for "freezing" the opposing player's pieces (e.g., black pieces 20); and moves under certain conditions wherein the acting player's piece (e.g., white piece 10) is able to move while "pushing" or "pulling" the opposing player's piece (e.g., black piece 20);.

The first and second players White/Black 100/200 alternate turns being the acting player until a one Rabbit 10*f*/20*f* is moved into a space 302 in the farthest-away row (row 8/row 1) on the opposite side of the board 300 from where the one Rabbit 10*f*/20*f* started after initial setup (i.e., the respective white/black goal row 128/228), thereby achieving a normal win for the player 100, 200 that owns the one Rabbit 10*f*/20*f*.

The rules provide for ways of ending a game session other than with a normal win:

(1) If both White 100 and Black 200 players lose all of their Rabbits 10*f*, 20*f*, respectively, the game session ends in a draw.

(2) If a player 100, 200 (e.g., White 100) is unable to make a move during his turn because all of that player's pieces 10, 20 (e.g., White pieces 10) are frozen or otherwise unable to move, then that player 100, 200 (e.g., White 100) that is unable to move has lost the game session, and the opposing player 100, 200 (e.g., Black 200) is declared the winner.

(3) If, after a turn, a same board position has been repeated for a third time (at any time during the game session, not necessarily in sequential turns), then the player 100, 200 (e.g., Black 200) that caused the same board position to occur the third time has lost the game session, and the opposing player 100, 200 (e.g., White 100) is declared the winner. The term board position is defined to mean a specific arrangement of pieces 10, 20 on the board 300. A second occurring board position is the same board position as a first occurring board position if arrangements of the pieces 10, 20 are such that each one of the pieces 10, 20 that is present in the first occurring board position is also present in the second occurring board position, and also such that each one of the pieces 10, 20 in the second occurring board position occupies the same space 302 that it occupied in the first occurring board position. Similarly, a third occurring board position is the same board position as the first and second occurring board positions if arrangements of the pieces 10, 20 are such that each one of the pieces 10, 20 that is present in the first and second occurring board positions is also present in the third occurring board position, and also such that each one of the pieces 10, 20 in the third occurring board position occupies the same space 302 that it occupied in the first and second occurring board positions.

(4) Either player 100, 200 (e.g., Black 200) may voluntarily forfeit the game session at any time, thereby causing the opposing player 100, 200 (e.g., White 100) to win the game session.

Rules of Movement

In order to describe the rules of movement, certain terms must be defined. Movement of any of the pieces 10, 20 is performed in steps, wherein one step consists of movement from a first space 302 to a second space 302 that is orthogonally adjacent to the first space 302. The term "orthogonal" refers to directions along a column or row, i.e., along the four compass directions (north, south, east, west) as illustrated in the Figures. Thus "orthogonally adjacent" means a second space 302 that is row-wise or column-wise adjacent to the first space 302. Of course, for any first space 302 located at an edge of the board 300 (e.g., rows 1 and 8 and columns a and h), there are no adjacent second spaces 302 beyond the edge of the board 300. For example, a first space d4 has four orthogonally adjacent second spaces: d5 to the north (up), d3 to the south (down), c4 to the west (left), and e4 to the east (right). For example, a first space a1 (space 302*a*) has only two orthogonally adjacent second spaces: a2 to the north (up), and b1 to the east (right). The left and right directions are referred to collectively as sideways directions, and the left direction is always equivalent to the west direction while the right direction is always equivalent to the east direction. The terms "forward" and "backward" are used for column-wise movement, and their meanings are dependent upon which player 100, 200 is the acting player who owns the piece 10, 20 being moved. The forward direction is directed from the first row 121, 221 toward the goal row 128, 228 of the piece 10, 20 being moved, and the backward direction is the opposite of the forward direction. Thus for all white pieces 10, the forward direction is up, or north, or column-wise in the direction of increasing row numbers; and the backward direction is down, or south, or column-wise in the direction of decreasing row numbers. Thus for all black pieces 20, the forward direction is down, or south, or column-wise in the direction of decreasing row numbers; and the backward direction is up, or north, or column-wise in the direction of increasing row numbers. For example, referring to FIG. 3, the white Elephant $\mathbf{10}a_1$ in space d4 can move forward to space d5 or backward to space d3, and the black Elephant $\mathbf{20}a_1$ in space f4 can move forward to space f3 or backward to space f5.

A "turn" generally refers to an opportunity for an acting player 100, 200 to move his pieces 10, 20. In the first turn of a game session the players 100, 200 move their respective pieces 10, 20 to the initial setup positions as described hereinabove. In all other turns, also known as movement turns, the acting player 100, 200 moves one or more of the pieces 10, 20 a total of one to four steps (at least one step and no more than four steps total) according to movement rules of the game 400. A piece 10, 20 can take multiple steps during one turn and may change directions after each step. The steps in a turn may be distributed among multiple pieces 10, 20 so that up to four pieces 10, 20 can be moved. The acting player 100, 200 can choose to skip one, two or three of the four steps, but at least one piece 10, 20 must be moved one step during the turn of the acting player 100, 200. Furthermore, the acting player 100, 200 must make a change to the board position by the end of his turn. According to the movement rules concerning manipulation of opposing player's pieces 10, 20 (described hereinbelow), the acting player 100, 200 may move an acting player's piece 10, 20 in a way that causes an opposing player's piece to move, and any steps thereby forced upon the opposing player's pieces 10, 20 are counted as steps in the acting player's turn. Thus for example, during a single turn of 4 steps, an acting player 100, 200 could move: four pieces 10, 20 one step each, one piece 10, 20 four steps in a variety of orthogonal directions, one piece 10, 20 two steps and two other pieces one step each, etc.

Movement Patterns:

All of the pieces 10, 20 except the weakest of the pieces 10, 20 (being the Rabbits 10*f*/20*f*) can move in the forward, backward, left and right directions; whereas the Rabbits 10*f*/20*f*, can move in the forward, left and right directions but cannot move backward. For each step in a move, a piece 10, 20 can only move into an orthogonally adjacent space 302 (never to a diagonally adjacent space 302), and cannot move into a space 302 while that space 302 is occupied by another piece 10, 20. For example, referring to FIG. 3, the white Rabbit $\mathbf{10}f_2$ in space c2 can move forward to space c3, left to space b2, and right to space d2, but not backward to space c1. Likewise, the black Rabbit $\mathbf{20}f_1$ in space g6 can move forward to space g5, left to space f6, and right to space h6, but not backward to space g7. All higher strength pieces 10, 20 can move in all four orthogonal directions such as, for example, the white Elephant 10$a_1$ in space d4 that can move forward to space d5, left to space c4, right to space e4, and backward to space d3. Similarly, the black Elephant 20$a_1$ in space f4 can move forward to space f3, left to space e4, and backward to space f5, but not right to space g4 only because the space g4 is occupied by another piece 10, 20 (the white Cat 10$e_1$).

Removal and Protect from Removal:

When a one player's piece 10, 20 is moved into a one of the trap spaces 310, the one player's piece 10, 20 is immediately removed from the game unless there is a friendly piece 10, 20 orthogonally adjacent to the one of the trap spaces 310, wherein the friendly piece 10, 20 is another piece 10, 20 that is owned by the one player 100, 200 that also owns the one piece 10, 20. It does not matter how the one player's piece 10, 20 is moved into the one of the trap spaces 310, whether by action of the one player 100, 200 that owns the one player's piece 10, 20, or by means of manipulation by an opposing player 100, 200. For example, in FIG. 4 the white Rabbit 20$f_3$ on the space f3 is removed from the game because the space f3 is a trap space 310 and there are no friendly white pieces 10 orthogonally adjacent to the trap space f3. However, the white Elephant 10$a_1$ on space c3 is not removed from the game and is free to move away from the space c3 even though the space c3 is a trap space 310 because a friendly white piece 10, the white Rabbit 10$f_1$, is orthogonally adjacent to the trap space c3 and is thus protecting the white Elephant 10$a_1$ from trap space removal.

Freeze, Unfreeze and Protect from Freezing:

When the active player's piece 10, 20 is orthogonally adjacent to a stronger opposing player's piece 10, 20, the active player's piece 10, 20 is "frozen" and cannot move unless there is a friendly piece 10, 20 (of any strength) orthogonally adjacent to it, in which case the friendly piece 10, 20 is "protecting" the active player's piece from being frozen. If the active player 100, 200 moves the friendly piece 10, 20 to a space 302 that is orthogonally adjacent to the active player's frozen piece 10, 20, then the active player's frozen piece 10, 20 is immediately "unfrozen" and thus able to move if steps remain in the active player's turn. For example, referring to FIG. 3, the white Rabbit 10$f_3$ in space b6 is frozen by the higher strength black Horse 20$c_1$ in the orthogonally adjacent space b7 such that the white player 100 cannot move his white Rabbit 10$F_3$ off the space b6. Conversely, the lower strength white Rabbit 10$f_3$ in space b6 does not freeze the black Horse 20$c_1$ in the orthogonally adjacent space b7, so the black Horse 20$c_1$ is free to be moved by the black player 200 to unoccupied orthogonally adjacent spaces 302 (right, left, and backward). In another example, the white Cat 10$e_1$ in space g4 is frozen by the higher strength does not freeze the black Elephant 20$a_1$. If the white player 100 were to move his white Rabbit 10$f_4$ from space g2 forward to the space g3 that is orthogonally adjacent to the space g4, then the white cat 10$e_1$ would be unfrozen and free to be moved up or to the right by the white player 100. Referring to FIG. 4, even though the black Elephant 20$a_1$ in space f4 is a higher strength than the white Dog 10$d_1$ in the orthogonally adjacent space e4, the white Dog 10$d_1$ is not frozen because it has a protective friendly piece 10, 20 (the white Rabbit 10$f_2$) in the orthogonally adjacent space d4, such that the white player 100 can move his white Dog 10$d_1$ to unoccupied orthogonally adjacent spaces 302 (forward and backward).

Push and Pull:

Depending on its strength, the active player's piece 10, 20 can move an opposing player's piece 10, 20 by means of a "pull" or a "push" move. In effect, a stronger piece 10, 20 can move a weaker opposing player's piece 10, 20.

In the push move, an active player's piece 10, 20 pushes an orthogonally adjacent and relatively weaker opposing player's piece 10, 20 out of the way (to any unoccupied space 302 that is orthogonally adjacent to the opposing player's piece 10, 20) and moves into the vacated space 302. The push counts as 2 steps of the active player's turn, one step for moving the opposing player's piece 10, 20 and a second step to move the active player's piece 10, 20 into the space 302 originally occupied by the opposing player's piece 10, 20. The stronger active player's piece 10, 20 can push the opposing player's weaker piece 10, 20 into any space 302 that is unoccupied and orthogonally adjacent to the opposing player's piece 10, 20, regardless of whether the opposing player's piece 10, 20 is frozen or protected or not allowed to move itself to that space (e.g., a Rabbit 10*f*/20*f* can be pushed or pulled backward). The active player's piece 10, 20 that is doing the push must not be frozen in it's original space 302. For example, referring to FIG. 5, assuming at least two steps are available to White 100 during White's turn as the active player 100, the white Elephant 10$a_1$ in space d5, being orthogonally adjacent to, and stronger than, the black Dog 20$d_1$ in space d6, pushes the black Dog 20$d_1$ leftward into the orthogonally adjacent space c6 in a first step of the push move. It may be noted that the white Elephant 10$a_1$ is not frozen by the weaker or equivalent strength pieces 10, 20 beside it. It may also be noted that the black Dog 20*d*1 is pushed even though it is protected by the friendly black Rabbit 20$f_1$. FIG. 6 illustrates a second step of the push move wherein the white Elephant 10$a_1$ has moved into the space d6 vacated by the black Dog 20$d_1$. It may be noted that, because the black Dog 20$d_1$ has been moved into a trap space 310 and isn't protected by a friendly piece 10, 20 beside the trap space 310, the black Dog 20$d_1$ is immediately removed from the game 400.

In the pull move, an active player's piece 10, 20 pulls an orthogonally adjacent and relatively weaker opposing player's piece 10, 20 into the space that the active player's piece 10, 20 vacates while moving to any unoccupied orthogonally adjacent space 302. The pull counts as 2 steps of the active player's turn, one step for moving the active player's piece 10, 20 and a second step to move the opposing player's piece 10, 20 into the space 302 originally occupied by the active player's piece 10, 20. The stronger active player's piece 10, 20 can pull the opposing player's weaker piece 10, 20 regardless of whether the opposing player's piece 10, 20 is frozen or protected or not allowed to move itself to that space. The active player's piece 10, 20 that is doing the pull must not be frozen in it's original space 302. For example, referring to FIGS. 5 and 7, assuming at least two steps are available to White 100 during White's turn as the active player 100, the white Elephant 10$a_1$ in space d5, being orthogonally adjacent to, and stronger than, the black Rabbit 20*f*2 in space d4 moves leftward into the orthogonally adjacent space c5 as a first step of the pull move. It may be noted that the white Elephant 10$a_1$ is not frozen by the weaker or equivalent strength pieces 10, 20 beside it. FIG. 8 illustrates a second step of the push move wherein the black Rabbit 20$f_2$ is pulled backward into the space d5 vacated by the white Elephant 10$a_1$. It may be noted that the black Rabbit 20$f_2$ is pulled backward even though it is not allowed to make such a move by itself, and also the black Rabbit 20$f_2$ is moved even though it was frozen by the stronger white Cat 10$e_1$.

Pushing and pulling can be done in the same turn, but only in sequence, i.e., a single active player's piece 10, 20 cannot pull a first opposing player's piece 10, 20 at the same time that the single active player's piece 10, 20 is pushing a second opposing player's piece 10, 20. An active player's piece 10, 20 can only move (push or pull) opposing player's pieces 10, 20 that are orthogonally adjacent to the active player's piece 10, 20 at the start of the push or pull move. A push or pull cannot be started unless it can be finished in the same turn. For example, referring to FIGS. 5 and 6, the white Elephant 10$a_1$ is not permitted to pull the black rabbit 20*f*2 into the space d5 while the white Elephant 10$a_1$ is pushing the black Dog 20$d_1$ out of space d6 and moving into space d6. The white Elephant 10$a_1$ could push the black Dog 20$d_1$ as shown in FIG. 6 for the first two steps of the white player's turn, and could then use the third step to move the white Elephant 10$a_1$ back into the space d5, but could not then pull the black Rabbit 20$f_2$ because the pull move requires two more steps and the active white player 100 only has one step remaining in his turn. On the other hand, the active white player 100 could follow the push shown as completed in FIG. 6 by pushing or pulling the other black Rabbit 20$f_1$ that is in space e6, orthogonally adjacent to the space d6 occupied by the white Elephant 10$a_1$ after the first two steps of the turn for the active white player 100.

In summary: Any piece 10, 20 can unfreeze and protect from freezing or from trap space removal of any other friendly piece 10, 20, regardless of relative strength. None of the pieces 10, 20 are able to protect any other piece 10, 20 from being moved (pushed or pulled) by an opposed active player 100, 200. Any piece 10, 20 that moves or is moved onto a trap space 310 is immediately removed unless protected by a friendly piece 10, 20.

The Rabbit 10*f*/20*f*, being the weakest piece, can't push, pull or freeze any other piece. Rabbits 10*f*/20*f* can move forward, left and right but cannot move backward.

The Cat 10*e*/20*e* is the second weakest piece and it can only push, pull or freeze the opposing player's Rabbits 10*f*/20*f*. Cats 10*e*/20*e* can move backward, forward, left and right.

The Dog 10*d*/20*d* is the third weakest piece and it can push, pull or freeze the opposing player's Cats 10*e*/20*e* and Rabbits 10*f*/20*f*. Dogs 10*d*/20*d* can move backward, forward, left and right.

The Horse 10*c*/20*c* is the third strongest piece and it can push, pull or freeze the opposing player's Cats 10*e*/20*e*, Dogs 10*d*/20*d*, and Rabbits 10*f*/20*f*. Horses 10*c*/20*c* can move backward, forward, left and right.

The Camel 10*b*/20*b* is the second strongest piece; it can push, pull or freeze all of the opposing player's pieces 10, 20 except for the Elephant 10*a*/20*a* and the equal strength Camel 10*b*/20*b*. The Camel 10*b*/20*b* can move backward, forward, left and right.

The Elephant 10*a*/20*a* is the strongest piece; it can push, pull or freeze all of the opposing player's pieces 10, 20 except the equal strength Elephant 10*a*/20*a*. The Elephant 10*a*/20*a* can move backward, forward, left and right. The Elephant 10*a*/20*a* cannot be pushed, pulled or frozen by any piece 10, 20.

Notation for Recording Game Sessions

In the preferred embodiment of the game 400, there are standard notations for recording game sessions. The pieces 10, 20 are indicated using upper or lower case letters to specify the piece color and piece type. Upper case letters are used for the white pieces 10 and lower case letters are used for the black pieces 20. Generally the first letter of each piece's name is used in the notation, except in the case of Camel 10*b*/20*b* wherein the letter "m" (for black Camel 20*b*) or "M" (for white Camel 10*b*) is used. Thus, "E" and "e" are used for white Elephant 10*a* and black Elephant 20*a*, respectively; "H" and "h" are used for white Horse 10*c* and black Horse 20*c*, respectively; "D" and "d" are used for white Dog 10*d* and black Dog 20*d*, respectively; "C" and "c" are used for white Cat 10*e* and black Cat 20*e*, respectively; and "R" and "r" are used for white Rabbit 10*f* and black Rabbit 20*f*, respectively.

As illustrated in FIG. 1, each space 302 on the board 300 is indicated by its intersecting column letter and row number. The lower case letters "a" through "h" are used to indicate the column and the numbers 1 to 8 are used to indicate the row, wherein the space a1 (space 302*a*) is at the bottom left corner 302*a* of the board 300 for the White player 100.

Each movement turn for a player 100, 200 is recorded on a separate line. The line starts with the turn number followed by the color of the side taking the turn (indicating white with a "w" and black with a "b"). For example 3w means turn number 3 for White 100; this would be followed by 3b which is turn number 3 for Black 200.

Initial setup placement of the pieces 10, 20 is recorded by indicating the piece 10, 20 and the space 302 on which it is placed. For example Da2 means the white Dog 10*d* is situated on space a2.

Movement of the pieces 10, 20 is recorded by indicating the piece 10, 20, the space 302 from which it moves, followed by the direction in which it moved. Directions are north ("n"), south ("s"), east ("e") and west("w") with respect to the white player 100 who is always shown located at the bottom of the board 300, i.e., at the south end of the board 300. For example, a notation of "Ea3n" means that the white Elephant 10*a* on space a3 moves north (to space a4 which is obvious and thus not included in the notation). For example, a notation of "hd7s" means that the black Horse 20*c* on space d7 moves south (to space d6).

The one to four steps of a player's turn are noted sequentially with a space between each notated step, but steps that are skipped are left blank.

When a piece 10, 20 is trapped and removed from the board 300, it is recorded by using an "x" to indicate removal. For example, a notation of "cf3x" means that the black Cat 20*e* on space f3 (one of the trap spaces 310) is removed. When a piece 10, 20 is trapped as a result of a push, the removal is recorded before the pushing piece's step that completes the push. For example, a notation of "rb3e rc3x Hb2n", notates the following sequence of two steps involving a push by the white Horse 10*c*: the black rabbit 20*f* on space b3 is pushed east (to space c3); whereupon the black rabbit 20*f* now on space c3 is removed; and the white Horse 10*c* on space b2 moves north (to space b3 originally occupied by the black rabbit 20*f*, thereby completing the push move).

When a player 100, 200 resigns, the word "resigns" is noted for the turn of the resigning player 100, 200. If a player loses 100, 200 because the opponent's weakest piece (Rabbit 10*f*/20*f*) has reached the first row 1, 8 of the losing player 100, 200 then the word "lost" is noted for the final turn of the losing player 100, 200. If the players 100, 200 agree to a draw, then the word "draw" is noted for a final turn.

According to standard rules for the preferred embodiment of the game 400, a turn cannot be taken back (undone) after the completion of a player's 100, 200 turn. However, if the players 100, 200 agree to allow takebacks, then when a turn is taken back the word "takeback" is noted for the turn and the count of the next turn becomes that of the previous turn.

The following example shows the notation used to record turns of a game session.

1w Ra2 Rb2 Mc2 Dd2 (etc., noting initial setup positions for all of White's pieces 10)

1b ra7 rb7 rc7 rd7 (etc., noting initial setup positions for all of Black's pieces 20)

2w Ra2n Ra3e Rb3n Rb4e

2b ra7s ra6s ra5e rb5e

3w Dd2n Dd3n Mc2e Rc4s Rc3x

3b rc7s rc5e rc6x rd5e re5s

4w takeback

3b takeback

3w Rb2n Rb3n Rb4n

3b . . . (etc.)

. . . (etc. for turns 4 through 15)

16w resigns

Seven tags according to the PGN (Portable Game Notation) format (as well as other tags) that are used in recording chess games can be used prior to recording the turns in an instance of playing the inventive game 400 (a game session). The tags are Event, Site, Date, Round, White, Black and Result. The format is simply the tag name followed by a colon (:) and a space character followed by a tag value. A blank line separates the tags from the turn listing. All tags are optional.

Here is a sample recording of a game session showing the use of tags:

Event: Casual Game

Site: Cleveland, Ohio USA

Date: Jan. 15, 1999

Round: ?

White: Aamir Syed

Black: Omar Syed

Result: 1–0

1w . . .

1b . . .

2w . . .

2b . . .

. . .

16b resigns

A tag which requires multiple lines should have the string "−=+=−" after the tag name. All lines until a next line that begins with this same string are considered to be the value of the tag.

For example:

Chat:−=+=−

2b White: hi, how are u

2b Black: fine, thanks

−=+=−

The "2b" just indicates that this chat was done when it was turn 2b (second turn for Black 200).

A sample position file, i.e., an easily printed representation of a specific board position is shown below. The first line of the file indicates the turn number and the player 100, 200 whose turn it is to move.

7w Daln Cc1n

| | a | b | c | d | e | f | g | h |
|---|---|---|---|---|---|---|---|---|
| 8 | | r | | r | r | | r | |
| 7 | m | | h | | | e | | c |
| 6 | | r | | r | r | | | |
| 5 | h | | d | | | c | | d |
| 4 | E | | H | | | H | | M |
| 3 | | R | | R | R | | R | |
| 2 | D | | C | | | C | | D |
| 1 | | R | | R | R | | R | |

Match Game Requirements

In the preferred embodiment of the game 400, players 100, 200 may not offer a draw. The intention of a match is to determine a winner. So when two players 100, 200 enter into a match they are not allowed to mutually end the match as a draw, but one of the players 100, 200 may resign at any time to end the match.

Time Controls

In the preferred embodiment of the game 400 time controls are used. An official match must be played with some form of time control. The time control used is specified as:

M/R/P/L/G/T wherein:

M (turn time) is the number of minutes:seconds allowed per turn;

R (reserve time) is the number of minutes:seconds in reserve;

P (percentage) is the percent of unused turn time that gets added to the reserve;

L (reserve limit) is the number of minutes:seconds to limit the reserve;

G (game limit) is the number of hours:minutes (alternatively, the maximum number of turns) after which the game session is halted and the winner is determined by score; and T (maximum turn time) is the number of minutes:seconds within which a player 100, 200 must complete the turn.

On each turn a player 100, 200 gets a fixed amount of turn time (M) for completing a turn, plus there may be some amount of reserve time (R) left in the reserve. If a player 100, 200 does not complete the turn within the turn time (M) then the reserve time (R) is used. If there is no more reserve time (R) remaining and the player 100, 200 has not completed the turn, then the player 100, 200 automatically loses. Even if there is turn time (M) or reserve time (R), but the player 100, 200 has not made the turn within the maximum turn time (T), then the player 100, 200 automatically loses. If a player 100, 200 completes the turn in less than the turn time (M), then a predetermined fraction of the remaining turn time (M) is added to the player's 100, 200 reserve time (R) as determined by multiplying the percentage (P) times the remaining turn time (M). The resulting reserve time (R) is rounded to the nearest second. If a value for the percentage (P) parameter has not been specified then the value of the percentage (P) is assumed to be 100%.

The reserve limit (L) can be specified in order to set an upper limit for the reserve time (R) such that the reserve time (R) does not exceed the value L of the reserve limit (L) when more time is added to the reserve. If an initial value for the reserve time (R) already exceeds the reserve limit (L) then more time is not added to the reserve time (R) until its value falls below the reserve limit (L). The reserve limit (L) is optional and if a reserve limit value L is not specified (including a value of 0) then it implies that there is no limit on how much time can be added to the reserve. For practical reasons a game limit (G) may be set. If the game session is not finished within the game limit (G), then the game session is halted and a winner is determined by scoring the game session. The game limit (G) parameter is optional and if a game limit value G is not specified (including a value of 0), then it means there is no limit on the time or number of turns in the game session.

In general, the initial setup is timed according to the rules for timing a single turn. However, when the turn time (M) is less than 1 minute, each player 100, 200 is given a 1 minute turn time (M) for initial setup, and if the initial setup is not completed in 1 minute then the reserve time (R) is also used. However, the unused time from the initial setup is not added to the reserve time (R) unless the player 100, 200 completes the initial setup in less than the turn time (M) set for the game session, in which case the percentage (P) parameter is used in the normal way to determine the amount of time to be added to the reserve time (R), subject to the reserve limit (L), if specified.

Different time units for any of the time control fields (M, R, L, T, G) can be specified by adding one of the following letters after the numbers. In such cases the letter serves as the separator and a colon (:) should not be used.

s—seconds
m—minutes
h—hours
d—days

When the game limit (G) parameter is being specified in terms of a maximum number of turns each player can take, then this is indicated by adding the letter t after the number.

In the preferred embodiment of the game 400, the default standard values for the parameters are: 4 minutes per turn for the turn time (M), a starting reserve time (R) of 4 minutes, 100% for the percentage (P) of the unused turn time being added to the reserve time (R), a reserve limit (L) of 4 minutes maximum reserve time (R); and a game limit (G) of 6 hours, after which the winner is determined by score.

If a game session is stopped for exceeding the game limit (G), then the Scoring System must be used and the winner is determined by a score calculated according to the Scoring System. Details of the Scoring System are given below.

Scoring System

In the preferred embodiment of the game 400, if a game session cannot be played out, then the Scoring System is used to determine a winner. The player 100, 200 with the higher score wins the game session. If the score of both players 100, 200 is the same, the game session is declared a draw. The score for each player 100, 200 is determined as follows:

$$\text{score}=Rp+P*(C+1)$$

Rp=Rabbit Points=a sum of points given for how far the player's Rabbits 10*f*/20*f* have progressed. A row value for the row to which each Rabbit 10*f*/20*f* has progressed is cubed (i.e., raised to the power of 3) and the cubed values are summed up to determine the total Rabbit points Rp. Each player's first row has a row value of 1 and each player's goal row has a row value of 8, with the rows in-between being valued sequentially from 2 to 7.

C=The number of Rabbits 10*f*/20*f* the player 100, 200 still has on the board 300.

P=Piece Points=a sum of piece values of each of the piece 10, 20 that the player 100, 200 still has on the board 300. The piece value for each piece is:

1—Rabbit 10*f*/20*f*
2—Cat 10*e*/20*e*
3—Dog 10*d*/20*d*
4—Horse 10*c*/20*c*
5—Camel 10*b*/20*b*
6—Elephant 10*a*/20*a*

Preferably the piece values equal the piece strengths.

Alternative Embodiments

A few of many possible alternative embodiments of the game 400 are now listed as examples that are not intended to limit the scope of the invention. For example, a game board 300 may have more than 64 spaces 302, and/or be gridded in other than an 8×8 arrangement of spaces 302. For example, more than six different types of pieces 10, 20 could be used. For example, more or less trap spaces 310 can be deployed in various spaces 302.

Advantages

The hereinabove described version of the present invention has many advantages, and results in a strategic board game 400 that is enjoyable and challenging for humans to play, but is difficult for computers.

There are several reasons why the game 400 is difficult for computers to play. First, the number of new board positions that can arise after a player 100, 200 takes a turn runs into the thousands as compared to an average of about thirty for chess. With a much greater range of possibilities at each turn it becomes extremely hard for computers to search through all of the potential moves to find the better moves. For example at the start of a chess game white has twenty possible moves. In the inventive game 400 a player 100, 200 has about 2,000 to 3,000 possible moves in the first turn depending on the way the player 100, 200 chooses to place the pieces 10, 20 for the initial setup. During mid-game the number of possible moves can range from about 5,000 to 40,000. If we assume an average of 20,000 possible moves at each turn, looking forward just two turns (each player 100, 200 taking two turns) means exploring about 160 million billion positions. Even if a computer was five times faster than Deep Blue and could evaluate a billion positions per second it would still take it more than five years to explore all the possible positions.

Another important factor is that the starting position of the game is not fixed as it is in chess. There are more than 64 million different ways in which each player 100, 200 can set up their pieces at the start of the game. This makes it very difficult for a computer to develop complete databases of opening moves. One of the difficulties that humans have when playing chess against computers is that they can easily fall into an opening trap. In order to avoid this, a human player 100, 200 must be extremely familiar with a very large number of chess openings. This basically boils down to memorization, which computers are extremely good at and humans are not. Even Bobby Fischer, a former World Champion, has proposed allowing different starting positions in chess to counter the problem of computers having an opening advantage.

Lastly computers will have difficulty with the inventive game 400 because it is much more of a positional game that relies more heavily on intuition than calculable tactics compared to chess. Computers are great at spotting tactics and taking advantage of them, but they have a much harder time trying to determine if a materially equivalent position is more advantageous for one side or the other. Chess Grand Masters are constantly trying to get their computer opponents into a positional disadvantage while trying to avoid tactical mistakes. After playing Deep Blue, Garry Kasparov wrote that the experience was like walking through a mine field. The inventive game 400 tips the scale in favor of humans by reducing reliance on tactics and giving more importance to position.

Although the invention has been illustrated and described in detail in the drawings and foregoing description, the same is to be considered as illustrative and not restrictive in character—it being understood that only preferred embodiments have been shown and described, and that all changes and modifications that come within the spirit of the invention are desired to be protected. Undoubtedly, many other variations on the themes set forth hereinabove will occur to one having ordinary skill in the art to which the present invention most nearly pertains, and such variations are intended to be within the scope of the invention, as disclosed herein.

What is claimed is:

1. A method for playing a strategic board game wherein the game is played by two or more players on a game board that is gridded to designate spaces such that pieces that are identifiable as belonging to each of the two or more players are positioned within, and moved among, the spaces; the method comprising the steps of:

requiring that the two or more players take turns for being an active player that is allowed to move one or more of the active player's pieces;

allowing the active player to move or position the active player's pieces in a way that manipulates by pushing or pulling an opposing player's pieces, wherein the opposing player's pieces are pieces that belong to an opposing player that is one of the two or more players other than the active player; and wherein:

pushing is a push move that comprises using a one of the active player's pieces to push a one of the opposing player's pieces out of a first space and into a second unoccupied space, and then moving the one of the active player's pieces into the first space; and pulling is a pull move that comprises moving a one of the active player's pieces out of a third space and into a fourth unoccupied space, and then using the one of the active player's pieces to pull a one of the opposing player's pieces into the third space.

2. The method of claim 1, wherein the step of manipulating the opposing player's pieces further comprises the step of:

using a one of the active player's pieces to freeze a one of the opposing player's pieces, thereby preventing movement of the one of the opposing player's pieces by the opposing player.

3. The method of claim 2, further comprising the step of:

providing means for any one of the two or more players to protect a piece that belongs to the one of the two or more players; such that protecting a one piece unfreezes or otherwise prevents freezing of the one piece.

4. The method of claim 1, wherein the game board further comprises one or more spaces that are designated as trap spaces; and the method further comprises the step of:

removing from the game a piece that is moved into a one of the one or more trap spaces.

5. The method of claim 4, further comprising the step of:

providing means for any one of the two or more players to protect a piece that belongs to the one of the two or more players; such that protecting a one piece prevents removal of the one piece when the one piece is in a one of the one or more trap spaces.

6. The method of claim 1, further comprising the step of:

limiting the step of manipulating the opposing player's pieces such that a one of the active player's pieces in a third space manipulates only a one of the opposing player's pieces in a fourth space provided that the fourth space is adjacent to the third space.

7. The method of claim 6, wherein the game board comprises a rectangular array of orthogonally adjacent spaces arranged in rows and columns; and the method further comprises the step of:

further defining adjacent spaces as spaces that are orthogonally adjacent, row-wise or column-wise.

8. The method of claim 1, further comprising the step of:

assigning a type to each one of the pieces belonging to each of the two or more players, wherein there are at least two varieties of type, and the varieties are at least visually distinguishable for all of the two or more players;

predetermining a strength value for each one of the at least two varieties of type, wherein the strength value is selected from a hierarchy of strength values from weak to strong, such that when a first piece having a first type with a first strength value is compared to a second piece having a second type with a second strength value, if the first strength value is stronger than the second strength value, then the first piece is a stronger piece relative to the second piece which is a weaker piece relative to the first piece; and allowing only stronger pieces to manipulate weaker pieces.

9. The method of claim 8, wherein the game board comprises a rectangular array of orthogonally adjacent spaces arranged in rows and columns; and the method further comprises the steps of:

assigning a first row, a second row, and a goal row for each one of the two or more players;

during the first turn of the game, each active player determining an initial setup for the active player's pieces wherein the active player's pieces are arranged in the spaces within the active player's first row and second row; and completing an instance of playing the strategic board game wherein one of the two or more players wins by being the first one of the two or more players to move a one of the winning player's weakest pieces to the goal row assigned to the winning player.

10. The method of claim 1, further comprising the steps of:

during one turn, allowing the active player to move or cause to move one or more of the pieces a total of one to four turn steps, wherein a turn step comprises a piece being moved from one space to any adjacent unoccupied space;

determining that a push move or a pull move uses two of the turn steps in a turn; and requiring that a push move or a pull move must be completed within one turn.

11. The method of claim 10, wherein the game board comprises a rectangular array of orthogonally adjacent spaces arranged in rows and columns; and the method further comprises the step of:

further defining adjacent spaces as spaces that are orthogonally adjacent, row-wise or column-wise.

12. The method of claim 1, further comprising the step of:

requiring that a first push move or pull move must be completed before a second push move or pull move can be performed.

13. A method for playing a strategic board game wherein the game is played by two or more players on a game board that is gridded to designate spaces such that pieces that are identifiable as belonging to each of the two or more players are positioned within, and moved among, the spaces; the method comprising the steps of:

requiring that the two or more players take turns for being an active player that is allowed to move one or more of the active player's pieces;

allowing the active player to move or position the active player's pieces in a way that manipulates by using a one of the active player's pieces to freeze a one of an opposing player's pieces, thereby preventing movement of the one of the opposing player's pieces by the opposing player; wherein the opposing player is one of the two or more players other than the active player;

assigning a type to each one of the pieces belonging to each of the two or more players, wherein there are at least two varieties of type and the varieties are at least visually distinguishable for all of the two or more players;

predetermining a strength value for each one of the least two varieties of type, wherein the strength value is selected from a hierarchy of strength values from weak to strong, such that when a first piece having a first type with a first strength value is compared to a second piece having a second type with a second strength value, if the first strength value is stronger than the second strength value, then the first piece is a stronger piece relative to the second piece which is a weaker piece relative to the first piece; and allowing only stronger pieces to manipulate weaker pieces.

14. The method of claim 13, further comprising the step of:

providing means for any one of the two or more players to protect a piece that belongs to the one of the two or more players; such that protecting a one piece unfreezes or otherwise prevents freezing of the one piece.

15. The method of claim 13, wherein the game board further comprises one or more spaces that are designated as trap spaces; and the method further comprises the step of:

removing from the game a piece that is moved into a one of the one or more trap spaces.

16. The method of claim 15, further comprising the step of:

providing means for any one of the two or more players to protect a piece that belongs to the one of the two or more players; such that protecting a one piece prevents removal of the one piece when the one piece is in a one of the one or more trap spaces.

17. The method of claim 13, further comprising the step of:

limiting the step of manipulating the opposing player's pieces such that a one of the active player's pieces in a third space manipulates only a one of the opposing player's pieces in a fourth space provided that the fourth space is adjacent to the third space.

18. The method of claim 13, wherein the game board comprises a rectangular array of orthogonally adjacent spaces arranged in rows and columns; and the method further comprises the steps of:

assigning a first row, a second row, and a goal row for each one of the two or more players;

during the first turn of the game, each active player determining an initial setup for the active player's pieces wherein the active player's pieces are arranged in the spaces within the active player's first row and second row; and completing an instance of playing the strategic board game wherein one of the two or more players wins by being the first one of the two or more players to move a one of the winning player's weakest pieces to the goal row assigned to the winning player.

19. The method of claim 13, further comprising the step of:

during one turn, allowing the active player to move or cause to move one or more of the pieces a total of one to four turn steps, wherein a turn step comprises a piece being moved from one space to any adjacent unoccupied space.

20. The method of claim 19, wherein the game board comprises a rectangular array of orthogonally adjacent spaces arranged in rows and columns; and the method further comprises the step of:

further defining adjacent spaces as spaces that are orthogonally adjacent, row-wise or column-wise.

21. A method for playing a strategic board game wherein the game is played by two or more players on a game board that is gridded to designate spaces such that pieces that are identifiable as belonging to each of the two or more players are positioned within, and moved among, the spaces; the method comprising the steps of:

designating one or more spaces as trap spaces by visibly marking the trap spaces;

allowing a player to move a piece into a trap space;

removing from the game a first one of a player's pieces that is on a trap space only if no second one of the same player's pieces is in a space that is adjacent to the trap space occupied by the first one of the player's pieces; and specifying that a first one of the player's pieces on a trap space will not be removed from the game only if a second one of the same player's pieces is in a space that is adjacent to the trap space occupied by the first one of the player's pieces.

22. The method of claim 21, wherein the game board comprises a rectangular array of orthogonally adjacent spaces arranged in rows and columns; and the method further comprises the step of:

further defining adjacent spaces as spaces that are orthogonally adjacent, row-wise or column-wise.

23. A strategic board game apparatus for playing a strategic board game by two or more players, the apparatus comprising:

a game board that is gridded to designate an array of spaces;

pieces that are identifiable as belonging to each of the two or more players, wherein the pieces can be positioned within, and moved among, the spaces; and one or more spaces that are identifiable as trap spaces for removing from the game a piece that is moved into a one of the one or more trap spaces:

the apparatus further comprising:

a type that is assigned to each one of the pieces belonging to each of the two or more players, wherein there are at least two varieties of type and the varieties are at least visually distinguishable for all of the two or more players; and a strength value that is predetermined for each one of the at least two varieties of type, wherein the strength value is selected from a hierarchy of strength values from weak to strong, such that when a first piece having a first type with a first strength value is compared to a second piece having a second type with a second strength value, if the first strength value is stronger than the second strength value then the first piece is a stronger piece relative to the second piece which is a weaker piece relative to the first piece; such that:

a one player's piece is only allowed to manipulate weaker pieces that belong to an other one of the two or more players, wherein manipulation comprises one piece causing or preventing movement of another piece;

and wherein:

the game board further comprises a rectangular array of sixty-four orthogonally adjacent spaces arranged in eight rows and eight columns; and the one or more trap spaces consist of four spaces, being spaces located at intersections of a third and sixth of the eight rows with a third and sixth of the eight columns.

24. A method for playing a strategic board game wherein the game is played by two or more players on a game board that is gridded to form a rectangular array of orthogonally adjacent spaces arranged in rows and columns such that pieces that are identifiable as belonging to each of the two or more players are positioned within, and moved among, the spaces; the method comprising the steps of:

assigning a type to each one of the pieces belonging to each of the two or more players, wherein there are at least two varieties of type and the varieties are at least visually distinguishable for all of the two or more players;

predetermining a strength value for each one of the at least two varieties of type, wherein the strength value is selected from a hierarchy of strength values from weak to strong, such that when a first piece having a first type with a first strength value is compared to a second piece having a second type with a second strength value, if the first strength value is stronger than the second strength value, then the first piece is a stronger piece relative to the second piece which is a weaker piece relative to the first piece;

assigning a first row, and a second row, and a goal row for each one of the two or more players, such that each player's goal row is the row that is farthest away from the player's first row and second row;

requiring that the two or more players take turns for being an active player that is allowed to move one or more of the active player's pieces;

during the first turn of the game, each active player determining an initial setup for the active player's pieces wherein the active player's pieces are arranged in the spaces within the active player's first row and second row; and completing an instance of playing the strategic board game wherein one of the two or more players wins by being the first one of the two or more players to move a one of the winning player's weakest pieces to the goal row assigned to the winning player.

25. The method of claim 24, further comprising the steps of:

designating one or more spaces as trap spaces;

removing a piece from the game only when the piece is moved into a one of the one or more trap spaces; and providing means for any one of the two or more players to protect a piece that belongs to the one of the two or more players; such that protecting a one piece prevents removal of the one piece when the one piece is in a one of the one or more trap spaces.

26. The method of claim 24, further comprising the steps of:

allowing the active player to move or position the active player's pieces in a way that manipulates an opposing player's pieces, wherein the opposing player's pieces are pieces that belong to an opposing player that is one of the two or more players other than the active player;

designating one or more spaces as trap spaces, and removing a piece from the game when the piece is moved into a one of the one or more trap spaces; and providing means for any one of the two or more players to protect a piece that belongs to the one of the more players; such that protecting a one piece prevents removal of the one piece when the one piece is in a one of the one or more trap spaces.

27. The method of claim 26 further comprising the steps of:

specifying a movement pattern for each type of piece wherein all movement patterns comprise stepwise movement from a first space to an unoccupied second space that is orthogonally adjacent to the first space;

limiting the step of manipulating the opposing player's pieces such that a one of the active player's pieces in a third space manipulates only a one of the opposing player's pieces in a fourth space provided that the fourth space is orthogonally adjacent to the third space;

during one turn, requiring the active player to move, or by means of manipulation cause to move, one or more of the pieces a total of one to four turn steps, wherein a turn step comprises a piece being moved from one space to any orthogonally adjacent unoccupied space; and requiring that manipulation causing movement of the opposing player's piece must be accompanied within the same turn by corresponding causative movement by the active player's piece.

28. The method of claim 27, further comprising the step of:

controlling an instance of playing the strategic board game by using time controls that comprise:

a turn time (M) that is the number of minutes:seconds allowed per active player's turn;

a player's reserve time (R) that is the number of minutes: seconds in a reserve maintained for each of the 2 or more players, for allowing extra time for the active player's turn;

a percentage (P) that is the percent of unused turn time that is added to the reserve when the active player declares completion of the active player's turn;

a reserve limit (L) that is an upper limit for the number of minutes:seconds in the reserve;

a maximum turn time (T) that is the number of minutes: seconds within which the active player must complete the active player's turn; and a game limit (G) that is the number of hour:minutes, or the number of turns, after which the instance of game playing is halted and the winner is determined by a scoring system; wherein:

the active player loses the instance of game playing whenever the active player fails to complete a turn within a total of the turn time plus the active player's reserve time (M+R), or within the maximum turn time (T), whichever amount of time is less; and when the active player completes the turn in less than the turn time, then the remaining amount of turn time is added to the active player's reserve time as determined by multiplying the percentage (P) times the remaining turn time, the total time in the active player's reserve time being limited to the reserve limit.

29. The method of claim 27, further comprising the step of:

using a scoring system to determine a winner for an incomplete instance of game playing, such that a one player having the highest Score is declared the winner, the scoring system comprising:

a Score tallied for each of the two or more players such that a player's Score equals a sum of Weakest-type Points (Rp) plus the product of Piece Points (P) times the sum of a Weakest-type Count (C) plus one, expressed in an equation as Score=Rp+P*(C+1); wherein:

the Weakest-type Points equal a sum of cubed row values for each one of the player's weakest pieces, wherein each row value is a number assigned to the row to which the one of the player's weakest pieces has progressed, and the row value number assignments consist of sequential integers that increase from the integer 1 as rows are counted from the player's first row, having a row value of 1, to the player's goal row;

the Weakest-type Count equals the number of weakest pieces that the player has on the game board; and the Piece Points equal a sum of piece type values for each of the pieces that the player has on the game board, wherein the piece type values are predetermined and increase with the strength value of the type.

* * * * *

UNITED STATES PATENT AND TRADEMARK OFFICE

CERTIFICATE OF CORRECTION

PATENT NO. : 6,981,700 B2
APPLICATION NO. : 10/679027
DATED : January 3, 2006
INVENTOR(S) : Syed et al.

It is certified that error appears in the above-identified patent and that said Letters Patent is hereby corrected as shown below:

The entire section of the "Brief Summary of the Invention", Column 4, Row 64 through Column 9, Row 18 should be deleted and the attached "Brief Summary of the Invention" should be inserted, pursuant to the Preliminary Amendment that was filed on October 16, 2003. Therefore no new material is being added.

BRIEF SUMMARY OF THE INVENTION

According to the invention a first aspect of a method is disclosed for playing a strategic board game wherein the game is played by two or more players on a game board that is gridded to designate spaces such that a quantity of pieces that are identifiable as belonging to each of the two or more players are positioned within, and moved among, the spaces; the method comprising the steps of: requiring that the two or more players take turns for being an active player that is allowed to move one or more of the active player's pieces; allowing the active player to move or position the active player's pieces in a way that manipulates by pushing or pulling an opposing player's pieces, wherein the opposing player's pieces are pieces that belong to an opposing player that is one of the two or more players other than the active player; and wherein: pushing is a push move that comprises using a one of the active player's pieces to push a one of the opposing player's pieces out of a first space and into a second unoccupied space, and then moving the one of the active player's pieces into the first space; and pulling is a pull move that comprises moving a one of the active player's pieces out of a third space and into a fourth unoccupied space, and then using the one of the active player's pieces to pull a one of the opposing player's pieces into the third space.

It is certified that error appears in the above-identified patent and that said Letters Patent is hereby corrected as shown below:

According to the invention, the step of manipulating the opposing player's pieces further comprises the step of using a one of the active player's pieces to freeze a one of the opposing player's pieces, thereby preventing movement of the one of the opposing player's pieces by the opposing player.

According to the invention, the first aspect of the method further comprises the step of providing means for any one of the two or more players to protect a piece that belongs to the one of the two or more players; such that protecting a one piece unfreezes or otherwise prevents freezing of the one piece.

According to the invention, the game board further comprises one or more spaces that are designated as trap spaces; and the first aspect of the method further comprises the step of removing from the game a piece that is moved into a one of the one or more trap spaces. The first aspect of the method even further comprises the step of providing means for any one of the two or more players to protect a piece that belongs to the one of the two or more players; such that protecting a one piece prevents removal of the one piece when the one piece is in a one of the one or more trap spaces.

According to the invention, the first aspect of the method further comprises the step of limiting the step of manipulating the opposing player's pieces such that a one of the active player's pieces manipulates only a one of the opposing player's pieces that is in a space that is adjacent to the one of the active player's pieces.

It is certified that error appears in the above-identified patent and that said Letters Patent is hereby corrected as shown below:

According to the invention, the first aspect of the method further comprises the steps of assigning a type to each one of the quantity of pieces belonging to each of the two or more players, wherein there are at least two varieties of type; predetermining a strength value for each one of the at least two varieties of type, wherein the strength value is selected from a hierarchy of strength values from weak to strong, such that when a first piece having a first type with a first strength value is compared to a second piece having a second type with a second strength value, if the first strength value is stronger than the second strength value, then the first piece is a stronger piece relative to the second piece which is a weaker piece relative to the first piece; and allowing only stronger pieces to manipulate weaker pieces. Furthermore, wherein the game board comprises a rectangular array of orthogonally adjacent spaces arranged in rows and columns; the first aspect of the method further comprises the steps of: assigning a first row, a second row, and a goal row for each one of the two or more players; during the first turn of the game each active player determining an initial setup for the active player's pieces wherein the active player's pieces are arranged in the spaces within the active player's first row and second row; and completing an instance of playing the strategic board game wherein one of the two or more players wins by being the first one of the two or more players to move a one of the winning player's weakest pieces to the goal row assigned to the winning player.

It is certified that error appears in the above-identified patent and that said Letters Patent is hereby corrected as shown below:

According to the invention, the first aspect of the method further comprises the steps of: during one turn, allowing the active player to move or cause to move one or more of the pieces a total of one to four turn steps, wherein a turn step comprises a piece being moved from one space to any adjacent unoccupied space; determining that a push move or a pull move uses two of the turn steps in a turn; and requiring that a push move or a pull move must be completed within one turn. Furthermore, wherein the game board comprises a rectangular array of orthogonally adjacent spaces arranged in rows and columns; the first aspect of the method further comprises the step of defining adjacent spaces as spaces that are orthogonally adjacent, row-wise or column-wise.

According to the invention, the first aspect of the method further comprises the step of requiring that a first push move or pull move must be completed before a second push move or pull move can be performed.

According to the invention, a second aspect of a method is disclosed for playing a strategic board game wherein the game is played by two or more players on a game board that is gridded to designate spaces such that a quantity of pieces that are identifiable as belonging to each of the two or more players are positioned within, and moved among, the spaces; the method comprising the steps of: requiring that the two or more players take turns for being an active player that is allowed to move one or more of the active player's pieces; and allowing the active player to move or position the active player's pieces in a way that manipulates by using a one of the active player's It is certified that error appears in the above-identified patent and that said Letters Patent is hereby corrected as shown below:

pieces to freeze a one of the opposing player's pieces, thereby preventing movement of the one of the opposing player's pieces by the opposing player.

According to the invention, the second aspect of the method further comprises the step of providing means for any one of the two or more players to protect a piece that belongs to the one of the two or more players; such that protecting a one piece unfreezes or otherwise prevents freezing of the one piece.

According to the second aspect of the method of the invention, the step of manipulating the opposing player's pieces further comprises the steps of: pushing or pulling an opposing player's pieces, wherein the opposing player's pieces are pieces that belong to an opposing player that is one of the two or more players other than the active player; and wherein: pushing is a push move that comprises using a one of the active player's pieces to push a one of the opposing player's pieces out of a first space and into a second unoccupied space, and then moving the one of the active player's pieces into the first space; and pulling is a pull move that comprises moving a one of the active player's pieces out of a third space and into a fourth unoccupied space, and then using the one of the active player's pieces to pull a one of the opposing player's pieces into the third space.

According to the second aspect of the method of the invention, wherein the game board further comprises one or more spaces that are designated as trap spaces; the method further comprises the step of removing from the game a piece that is moved into a one of the one or more trap spaces. The second aspect of the method even further It is certified that error appears in the above-identified patent and that said Letters Patent is hereby corrected as shown below:

comprises the step of providing means for any one of the two or more players to protect a piece that belongs to the one of the two or more players; such that protecting a one piece prevents removal of the one piece when the one piece is in a one of the one or more trap spaces.

According to the invention, the second aspect of the method further comprises the step of limiting the step of manipulating the opposing player's pieces such that a one of the active player's pieces manipulates only a one of the opposing player's pieces that is in a space that is adjacent to the one of the active player's pieces.

According to the invention, the second aspect of the method further comprises the steps of assigning a type to each one of the quantity of pieces belonging to each of the two or more players, wherein there are at least two varieties of type; predetermining a strength value for each one of the at least two varieties of type, wherein the strength value is selected from a hierarchy of strength values from weak to strong, such that when a first piece having a first type with a first strength value is compared to a second piece having a second type with a second strength value, if the first strength value is stronger than the second strength value, then the first piece is a stronger piece relative to the second piece which is a weaker piece relative to the first piece; and allowing only stronger pieces to manipulate weaker pieces. Furthermore, wherein the game board comprises a rectangular array of orthogonally adjacent spaces arranged in rows and columns; the second aspect of the method further comprises the steps of: assigning a It is certified that error appears in the above-identified patent and that said Letters Patent is hereby corrected as shown below:

first row, a second row, and a goal row for each one of the two or more players; during the first turn of the game, each active player determining an initial setup for the active player's pieces wherein the active player's pieces are arranged in the spaces within the active player's first row and second row; and completing an instance of playing the strategic board game wherein one of the two or more players wins by being the first one of the two or more players to move a one of the winning player's weakest pieces to the goal row assigned to the winning player.

According to the invention, the second aspect of the method further comprises the step of: during one turn, allowing the active player to move or cause to move one or more of the pieces a total of one to four turn steps, wherein a turn step comprises a piece being moved from one space to any adjacent unoccupied space.

According to the second aspect of the inventive method, wherein the game board comprises a rectangular array of orthogonally adjacent spaces arranged in rows and columns; the second aspect of the method further comprises the step of defining adjacent spaces as spaces that are orthogonally adjacent, row-wise or column-wise.

According to the invention, a third aspect of a method for playing a strategic board game is disclosed wherein the game is played by two or more players on a game board that is gridded to designate spaces such that a quantity of pieces that are identifiable as belonging to each of the two or more players are positioned within, and moved among, the spaces; the third aspect of the method comprising the steps of:

designating one or more spaces as trap spaces; and removing from the game a piece that is moved into a one of the one or more trap spaces.

According to the invention, the third aspect of the method further comprises the step of providing means for any one of the two or more players to protect a piece that belongs to the one of the two or more players; such that protecting a one piece prevents removal of the one piece when the one piece is in a one of the one or move trap spaces.

According to the invention, a fourth aspect of a method for playing a strategic board game is disclosed wherein the game is played by two or more players on a game board that is gridded to form a rectangular array of orthogonally adjacent spaces arranged in rows and columns such that a quantity of pieces that are identifiable as belonging to each of the two or more players are positioned within, and moved among, the spaces; the fourth aspect of the method comprising the steps of: assigning a type to each one of the quantity of pieces belonging to each of the two or more players, wherein there are at least two varieties of type; predetermining a strength value for each one of the at least two varieties of type, wherein the strength value is selected from a hierarchy of strength values from weak to strong, such that when a first piece having a first type with a first strength value is compared to a second piece having a second type with a second strength value, if the first strength value is stronger than the second strength value, then the first piece is a stronger piece relative to the second piece which is a weaker piece relative to the first piece; assigning a first row, a second row, and a goal It is certified that error appears in the above-identified patent and that said Letters Patent is hereby corrected as shown below:

row for each one of the two or more players; requiring that the two or more players take turns for being an active player that is allowed to move one or more of the active player's pieces; during the first turn of the game, each active player determining an initial setup for the active player's pieces wherein the active player's pieces are arranged in the spaces within the active player's first row and second row; and completing an instance of playing the strategic board game wherein one of the two or more players wins by being the first one of the two or more players to move a one of the winning player's weakest pieces to the goal row assigned to the winning player.

According to the invention, a strategic board game apparatus for playing a strategic board game by two or more players is disclosed, the apparatus comprising: a game board that is gridded to designate an array of spaces; a quantity of pieces that are identifiable as belonging to each of the two or more players, wherein the pieces can be positioned within, and moved among, the spaces; and one or more spaces that are identifiable as trap spaces for removing from the game a piece that is moved into a one of the one or more trap spaces.

Further according to the invention, the game board comprises a rectangular array of orthogonally adjacent spaces arranged in rows and columns. Furthermore, a type is assigned to each one of the quantity of pieces belonging to each of the two or more players, wherein there are at least two varieties of type; a strength value is predetermined for each one of the at least two varieties of type, wherein the strength

UNITED STATES PATENT AND TRADEMARK OFFICE

CERTIFICATE OF CORRECTION

PATENT NO. : 6,981,700 B2
APPLICATION NO. : 10/679027
DATED : January 3, 2006
INVENTOR(S) : Syed et al.

It is certified that error appears in the above-identified patent and that said Letters Patent is hereby corrected as shown below:

value is selected from a hierarchy of strength values from weak to strong, such that when a first piece having a first type with a first strength value is compared to a second piece having a second type with a second strength value, if the first strength value is stronger than the second strength value, then the first piece is a stronger piece relative to the second piece which is a weaker piece relative to the first piece; and a first row, a second row, and a goal row are assigned for each one of the two or more players; such that an initial setup of pieces comprises positioning pieces within the first row and the second row, and an instance of the game is won by moving a designated type of piece to the goal row.

Other objects, features and advantages of the invention will become apparent in light of the following description thereof.

Signed and Sealed this

Twenty-seventh Day of May, 2008

JON W. DUDAS
*Director of the United States Patent and Trademark Office*